US006314263B1

(12) United States Patent
Yoshida et al.

(10) Patent No.: US 6,314,263 B1
(45) Date of Patent: Nov. 6, 2001

(54) TONER CARRIER AND IMAGE FORMING APPARATUS

(75) Inventors: Sadaaki Yoshida, Kawasaki; Michiaki Ito, Yokohama, both of (JP)

(73) Assignees: Fujitsu Limited, Kawasaki; Hokushin Corporation, Yokohama, both of (JP)

( * ) Notice: Subject to any disclaimer, the term of this patent is extended or adjusted under 35 U.S.C. 154(b) by 0 days.

(21) Appl. No.: 09/482,516

(22) Filed: Jan. 14, 2000

(30) Foreign Application Priority Data

Jun. 29, 1999 (JP) ..... 11-184227

(51) Int. Cl.[7] ..... G03G 15/08
(52) U.S. Cl. ..... 399/286; 399/359
(58) Field of Search ..... 399/286, 55, 235, 399/270, 279, 280, 285, 359, 360; 430/120; 429/40.9, 209; 492/16, 17, 18, 56

(56) References Cited

U.S. PATENT DOCUMENTS 6,032,012 * 2/2000 Hirono et al. ..... 399/285 X
6,067,434 * 5/2000 Takagi et al. ..... 399/286
6,108,509 * 8/2000 Okada et al. ..... 399/286

FOREIGN PATENT DOCUMENTS 63-100482 5/1988 (JP) .
1-252979 10/1989 (JP) .
6-202502 7/1994 (JP) .
8-137223 5/1996 (JP) .
8-257778 10/1996 (JP) .
9-171299 6/1997 (JP) .
10-20633 1/1998 (JP) .
10-265542 10/1998 (JP) .

* cited by examiner

*Primary Examiner*—Sophia S. Chen
*Assistant Examiner*—Hoan Tran
(74) *Attorney, Agent, or Firm*—Armstrong, Westerman, Hattori, McLeland & Naughton, LLP

(57) ABSTRACT

A toner carrier is included in an image forming apparatus wherein the electrical resistance between a shaft of the toner carrier and a surface which covers the shaft is different depending on the polarity of the voltage applied between th shaft and the surface. A resistance characteristic is thereby obtained having a resistance that allows prescribed current to flow from the shaft side to the surface side and which makes current flow from the surface side to the shaft side difficult. This prevents leakage current being received from the surface of the photosensitive drum. The amount of charging up of the toner therefore does not drop and a prescribed amount of charging up can be maintained, which means that fog of the image background surface does not occur. Furthermore, because there is no voltage dependence at the toner carrier surface from the shaft side, stable image density can be achieved, enabling high image quality to be achieved.

13 Claims, 15 Drawing Sheets

Voltage Dependency of Resistance of a Developing Roller According to Present Invention Voltage Dependency of Resistance of a Developing Roller According to Prior Art Conditions: • Sending A4 Office W Paper Vertically

• Toner Layer Thickness: 8～8.5μm

*Using Developing Roller of Rz 8.0

Viscosity 5.5cm Poise

TONER CARRIER AND IMAGE FORMING APPARATUS

BACKGROUND OF THE INVENTION

1. Field of the Invention

The present invention relates to a toner carrier (hereinbelow referred to as a developing roller) and to an image forming apparatus which has a non-magnetic single-component developing apparatus that makes visible an electrostatic latent image formed on an electrostatic latent image holder (hereinbelow referred to as a photosensitive drum), using this toner carrier.

2. Description of the Related Art

In recent years, with the advance of office automation, considerable use is made of electro-photographic image forming apparatuses such as computer output terminal apparatuses, facsimile machines and photocopiers. In such apparatuses, a photosensitive drum is charged up by a charger and an electrostatic latent image is formed on the photosensitive drum by illumination with light. Then, toner (developer), which is controlled to be of uniform thickness on the developing roller, is made to adhere electrically to an electrostatic latent image on the photosensitive drum, thereby developing the image, which is then transferred to recording paper and fixed. After transfer, the residual toner on the photosensitive drum that was not transferred is recovered by a cleaner, and preparations are made for the next printing.

In this process, the recovered residual toner becomes spent toner, and is accommodated in a receiving box before being subjected to disposal treatment; however, since the spent toner is a powder, this disposal treatment presents a problem. It is therefore desirable, from the point of view of running costs and environmental protection that the spent toner should be used up or employed for recycling. However, the residual toner on the photosensitive drum after transfer is subject to toner quality variability such as for example of the toner particle size, content of external additives, and adhesion characteristics, and this may cause failure of electrical charging or non-uniform electrical charging.

Also, since, during transfer, the paper is in contact with or in proximity with the photosensitive drum, dust such as paper dust sticks to the photosensitive drum and is recovered by the cleaner in the same way as the residual toner; toner returned to the developing apparatus therefore undergoes severe deterioration which makes recharging difficult, resulting in problems such as a low degree of charging up, giving rise to contamination i.e. so-called "fog" (hereinbelow referred to as "fog") in the image background. Reuse is therefore difficult.

Methods of development employed in such an apparatus include: the single-component developing method, in which only toner constituting non-magnetic single-component developer is employed, and the dual-component developing method in which a carrier is employed in addition to the toner. The single-component developing method has the advantage that the construction of the image forming apparatus is simplified, since no particular care needs to be exercised regarding carrier deterioration or the mixing ratio of carrier and toner, since no carrier is employed.

Also, in the case where the single-component developing method is used, in contrast with the case where adhesion on to a magnetic roller is effected by employing a developing agent comprising a mixture of carrier and toner as in the dual-component developing method, since the single-component developing agent does not employ a carrier, adhesion is effected by conferring charge on the developing roller by forcibly charging up the developing agent.

To achieve this, toner of comparatively high volume resistivity is employed; if, for example, toner of $10^{10}$ to $10^{13}$ Ω·cm is employed, it is necessary that this should be forcibly charged up to the prescribed polarity. A well-known conventional arrangement for achieving this is to confer frictional charging-up charge on the toner by a frictional charging member. As the frictional charging member, in the case of a toner layer thickness regulating blade, for example, a blade whose tip is constituted by a frictional charging member consisting, for example, of silicone rubber or polyurethane is employed; in the case of a roller whereby toner is supplied and recovered, for example, a roller constituted by a frictional charging member consisting of, for example, conductive silicone sponge or polyurethane sponge is employed. Using a developing roller that is in contact with both members, frictional charging-up of toner can be achieved with a construction of optimum simplicity and low cost.

Problems in the application of such a conventional developing roller are described below. In the contact developing method, in order to achieve effectiveness of the developing electrode and effectiveness of the developing bias, the developing roller is formed with a conductive resilient layer at the circumference of its shaft and, if necessary, it is desirable that bias voltage should be applied thereto. However, environmental variation (in particular, rise in temperature), etc., is produced by addition of plasticizers and/or softeners, etc., in order to achieve the prescribed resistance and/or hardness, and the phenomenon of bleeding of these additives occurs, causing contamination of the photosensitive drum.

Thus, when a conductive resilient layer such as rubber is formed on the developing roller, the problem arises that image loss on the printed surface is caused by contamination of the surface of the photosensitive drum due to migration of the softening agent, etc., from the conductive resilient layer to the photosensitive drum. In order to prevent contamination of the surface of the photosensitive drum, it is therefore necessary to provide a film consisting of a member that does not contaminate the surface of the conductive resilient layer, in order to prevent contamination of the photosensitive drum surface.

In order to solve this problem, use of surface films of conductive resilient layer member constituted by a resin coating is known. However, in the case of a resin film, there are problems in that the equipment may become unusable if peeling occurs if there is poor adhesion with the resilient layer and/or the wear resistance of rubber etc. is poor. Furthermore, if a hard resin layer is formed by addition of for example conductive carbon, the toner is melted by the heat of friction with the result that it fuses on to the surface of the developing blade or filming occurs due to adhesion thereof to the surface of the developing roller.

Also, the resin film of the developing roller has the function of a frictional charging-up member and, due to interaction with the toner, for example in regard to charging-up polarity and/or coefficient of friction etc., may give rise to toner of reversed charging polarity or may give rise to uncharged toner or non-uniformly charged toner, creating problems of fog.

Also, due to the different water-absorbing characteristics of resin members, there may be considerable fluctuations in electrical resistance, depending on the environment. That is, since the resistance becomes high at low temperature compared with normal temperature and at low humidity and contrariwise falls at high temperature and high humidity, the amount of charging up of the toner also becomes high under low temperature and low humidity and falls under high temperature and high humidity. If therefore the amount of charging up of the toner becomes too much higher than the prescribed amount of charging up, when the electrostatic latent image is made visible, this is done with a smaller quantity of toner causing a drop in density; if the amount of charging up of the toner is too much lower than the prescribed amount of charging, this gives rise to the problem of fog of the image background. Furthermore, if the distribution of the amount of charging up among the toner particles is widened, there is the problem that such drop in density or fog is rendered even more severe.

There is therefore an appropriate amount of charging for the toner and problems arise if it is higher or lower than this. Furthermore, it is important that the distribution of the toner particles should be narrow. Furthermore, in order to provide high picture quality in stable fashion, it is necessary to maintain the amount of charging and the charge distribution constant irrespective of the number of printed sheets and/or changes in the environment. To achieve this, it is necessary that the amount of frictional charging should not change, even if the environment or number of printed sheets etc. changes. A non-magnetic single-component developing roller must therefore confer a stable charge on the toner.

SUMMARY OF THE INVENTION

With the foregoing problems in view, an object of the present invention is therefore to provide a toner carrier whereby an appropriate amount of charging of the toner can be maintained and an image forming apparatus using this.

In order to achieve the above object, there are provided a toner carrier and an image forming apparatus including the toner carrier, the toner carrier comprising:

a conductive shaft;

a conductive resilient layer provided at the circumference of said conductive shaft; and a surface film which covers said conductive resilient layer and on which toner is charged up and adheres, wherein the electrical resistance between said conductive shaft and said surface film is different depending on the polarity of the voltage applied between said conductive shaft and said surface film.

Preferrably, the toner carrier has an electrical resistance characteristic satisfying the relationship $2<R1/R2<40$ where R1 is the resistance in case that a positive voltage is applied at the side of said surface film and a negative voltage is applied at the side of said conductive shaft and R2 is the resistance in case that a positive voltage is applied at the side of said conductive shaft and a negative voltage is applied at the side of said surface film.

Owing to the fact that from the conductive shaft side to the side of the surface of the developing roller it has a resistance permitting a prescribed current to flow but from the side of the surface of the developing roller to the conductive shaft side it has a resistance characteristic that makes it difficult for current to flow, the toner is not subject to leakage current from the surface of the photosensitive drum so the prescribed amount of charging up of the toner can be maintained without decrease so fog of the image background does not occur. Furthermore, since there is no voltage dependence from the shaft side to the side of the surface of the developing roller, stable image density can be obtained, enabling an image of high quality to be obtained.

DESCRIPTION OF THE PREFERRED EMBODIMENTS

Embodiments of the present invention are described below with reference to the drawings. However, these embodiments are not to be taken as limiting the scope of the present invention.

Figure 1:
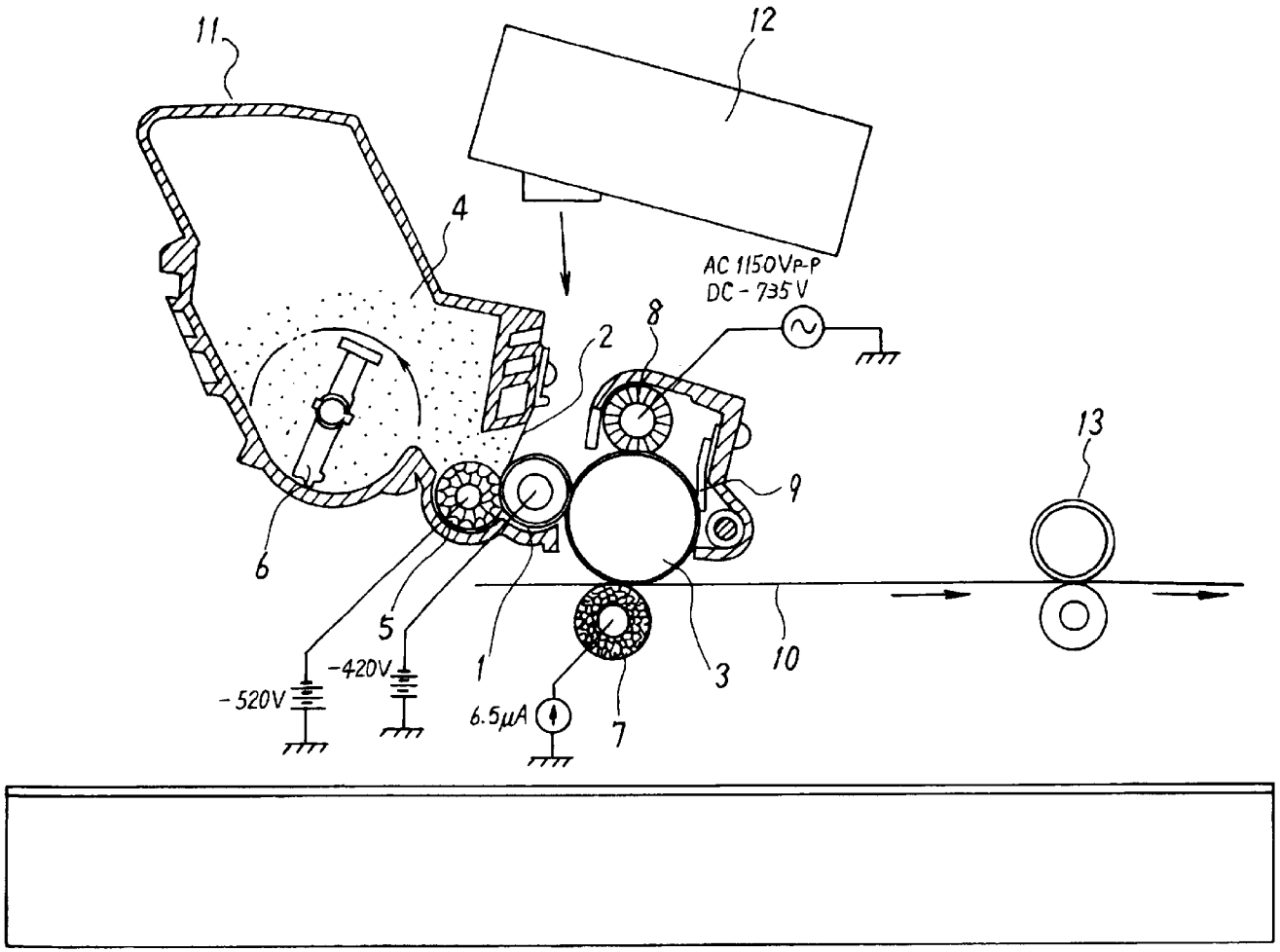
FIG. 1 is a view illustrating an image formation apparatus according to an embodiment of the present invention.

FIG. 1 is a view illustrating an image forming apparatus according to an embodiment of the present invention. In FIG. 1, photosensitive drum 3 is for example of diameter 30 mm and is rotated with a peripheral speed of 72.8 mm/sec. Pre-charging is performed by rotary brush 8, which charges up the surface potential of photosensitive drum 3 to about −735 V. A latent image in accordance with the printing information is formed on photosensitive drum 3 by optical illumination performed by laser scanning optical system 12. This causes the potential of the latent image portion to vary in the amount of about −50 V. The laser power is set at for example 0.24 mw.

Toner stored in toner storage container 11 is supplied to developing roller 1 at developing blade 2 by the rotation of toner supply and recovery roller 5 and is thus transported to developing blade 2, so that a thin toner layer of prescribed thickness is formed on the surface of developing roller 1 by this developing blade 2. The toner is supplied to developing roller 1 whilst being agitated by agitator 6 within toner storage container 11, so that the toner is efficiently supplied to toner supply and recovery roller 5. The chief constituent of the toner that is stored in toner storage container 11 is polyester resin and its charging polarity is negative.

Developing roller 1 that is in contact with photosensitive drum 3 contacts photosensitive drum 3 whilst rotating in the same direction with a peripheral speed of 1.55 times that of photosensitive drum 3. Since the surface of developing roller 1 is given a potential of about −420 V, due to the difference between the surface potential of developing roller 1 and the surface potential of photosensitive drum 3, in respect of the latent image portion, toner is shifted from developing roller 1 to photosensitive drum 3. The latent image is thereby rendered visible. The toner adhering to photosensitive drum 3 is pulled on to the paper by transfer roller 7 and is fixed to the paper by being melted by fixing apparatus 13. Also, the residual toner left on the surface of the photosensitive drum 3 is recovered by cleaning blade 9 and is transported by rotation of a screw (not shown) to the upper central part of toner storage container 11, where it falls under its own weight and is returned to the interior of toner storage container 11, being thus recycled. Furthermore, any toner that did not contribute to the developing of developing roller 1 is scraped off by toner supply and recovery roller 5 that is rotating in the opposite direction below developing roller 1 and is thereby returned into toner storage container 11 through the bottom part of this roller 5.

Figure 2:
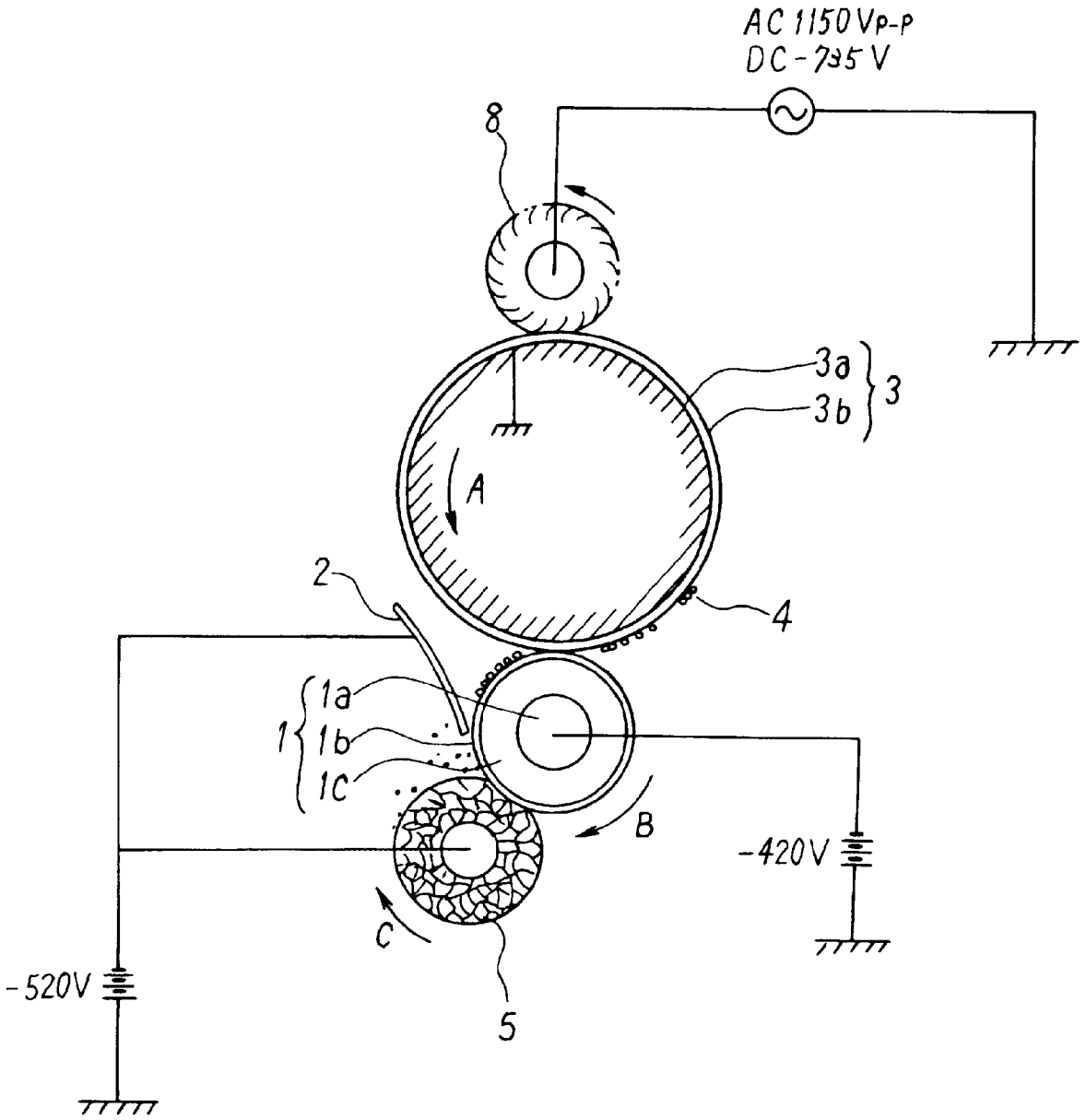
FIG. 2 is a view to a larger scale of the vicinity of developing roller 1, photosensitive drum 3, and toner supply and recovery roller 5.
Figure 3A:
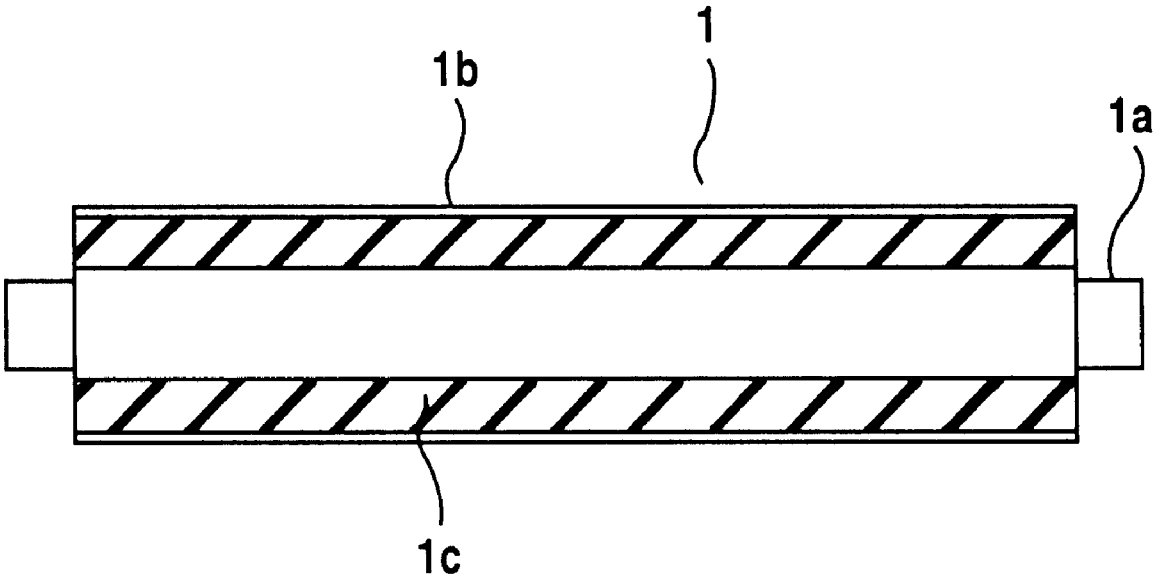
FIG. 3A is a front cross-sectional view of a developing roller.
Figure 3B:
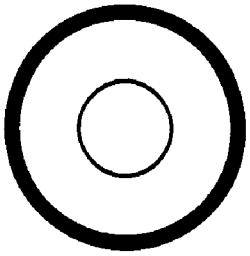
FIG. 3B is a side view of the developing roller.

FIG. 2 is a view to a larger scale of the vicinity of developing roller 1, photosensitive drum 3, and toner supply and recovery roller 5. In FIG. 2, arrows A, B and C respectively indicate the directions of rotation of photosensitive drum 3, developing roller 1 and toner supply and recovering roller 5. Also, FIG. 3A is a front cross-sectional view of development roller 1, which is constituted by shaft 1*a,* resilient layer 1*c,* and surface film (hereinbelow referred to as "surface") 1*b*. FIG. 3B is a side view of the roller. As shown in FIG. 2, developing roller 1 is arranged adjacent with or in contact with in the direction of arrow B roller-shaped photosensitive drum 3 that rotates in the direction of arrow A and roller 5 that rotates in the direction of arrow C is arranged adjacent with developing roller 1. Blade 2 is arranged between photosensitive drum 3 and roller 5 such that the tip of blade 2 is in facing sliding contact in the direction of rotation B of developing roller 1 with the surface of developing roller 1.

In FIG. 2, charge of applied voltage DC-735 V and AC 1150 V P-P is applied to charging brush 8. Also, a prescribed voltage is applied from charging brush 8 to photosensitive drum surface 3*b,* thereby charging up photosensitive drum surface 3*b,* while applied voltage of −520 V is applied to roller 5 and blade 2 and applied voltage of −420 V is applied to developing roller 1. Toner that is transported by the rotation of roller 5 is charged up by charge injection and frictional charging with developing roller 1 that is rotating in contact with roller 5 and is thereby attached to the surface of developing roller 1. Toner 4 adhering on to developing roller 1 is subjected to even higher frictional charging-up by friction under applied pressure and charge injection by blade 2 and developing roller 1 by rotation of developing roller 1 and a prescribed toner layer is thus formed uniformly as it passes through. Also, toner 4 is transported into the developing region in which developing roller 1 and photosensitive drum 3 face each other adjacently or in contact. Some of the toner 4 or developing roller 1 adheres to the electrostatic latent image portion on photosensitive drum 3, thereby rendering this electrostatic latent image visible, while the rest of the toner returns to roller 5 with rotation of developing roller 1.

Now, as mentioned above, fog may occur either because the amount of charging up of the toner on the developing roller 1 has not reached the prescribed amount of charging up, or because the charged-up toner has lost its charge. Fog due to loss of charge by toner 4 occurs for the following reasons. Specifically, in order to render the electrostatic latent image visible, a potential difference is provided between the surface potential of photosensitive drum 3 and the surface potential of developing roller 1. That is, since the relationship is set that the potential of the photosensitive drum surface > the potential of the developing roller surface, leakage occurs at photosensitive drum surface 3*b* and developing roller surface 1*b*. During this process, toner 4 between photosensitive drum 3 and developing roller 1 receives the leakage current and thereby loses charge; as a result, the amount of charging up of the toner falls below the prescribed amount of charging up, giving rise to fog in the image background. Thus, even if the charging amount of the toner on the developing roller reaches the prescribed charging amount, if the charging amount of the toner cannot maintain the prescribed charging amount, fog will be generated.

Therefore, in cases where fog occurs due to loss of charge by the toner, it is necessary to make it difficult for current leakage to occur from photosensitive drum surface 3*b* to developing roller surface 1*b*. That is, in order to render the electrostatic image visible, toner 4 having a prescribed amount of charge on the surface of the developing roller is necessary. To this end, when developing bias is applied, the surface electrode of the developing roller must have a prescribed resistance and a developing roller surface electrode is necessary in which there is both little voltage dependence and that has a current rectifying action such as to suppress leakage current from photosensitive drum surface 3*b*.

Developing roller 1 that is characteristic of the present embodiment of the invention has a resistance R1 such that a prescribed current can flow when a negative voltage is applied to the side of shaft 1*a* and a positive voltage is applied to the side of developing roller surface 1*b* and has a resistance R2 such that current cannot easily flow when a positive voltage is applied to the side of developing roller surface 1*b* and a negative voltage is applied to the side of shaft 1*a*. As a result, the amount of charging of the toner does not drop and the prescribed amount of charge is maintained, so fog of the image background does not occur. That is, it is necessary that developing roller 1 should have a frictional charging function and should have a current rectifying characteristic such that the electrical resistances have the relationship R1<R2 i.e. such that current flows in one direction only with difficulty.

Also, since, when a negative voltage is applied to the side of shaft 1*a* and a positive voltage is applied to the side of developing roller surface 1*b*, there is no voltage dependence, with the result that stable charging of the toner on the developing roller takes place, the image density can be produced in a stable fashion and a high-quality image with no fog can be obtained.

An embodiment of a developing roller 1 according to the present invention is described below.

[Embodiment]

Figure 4:
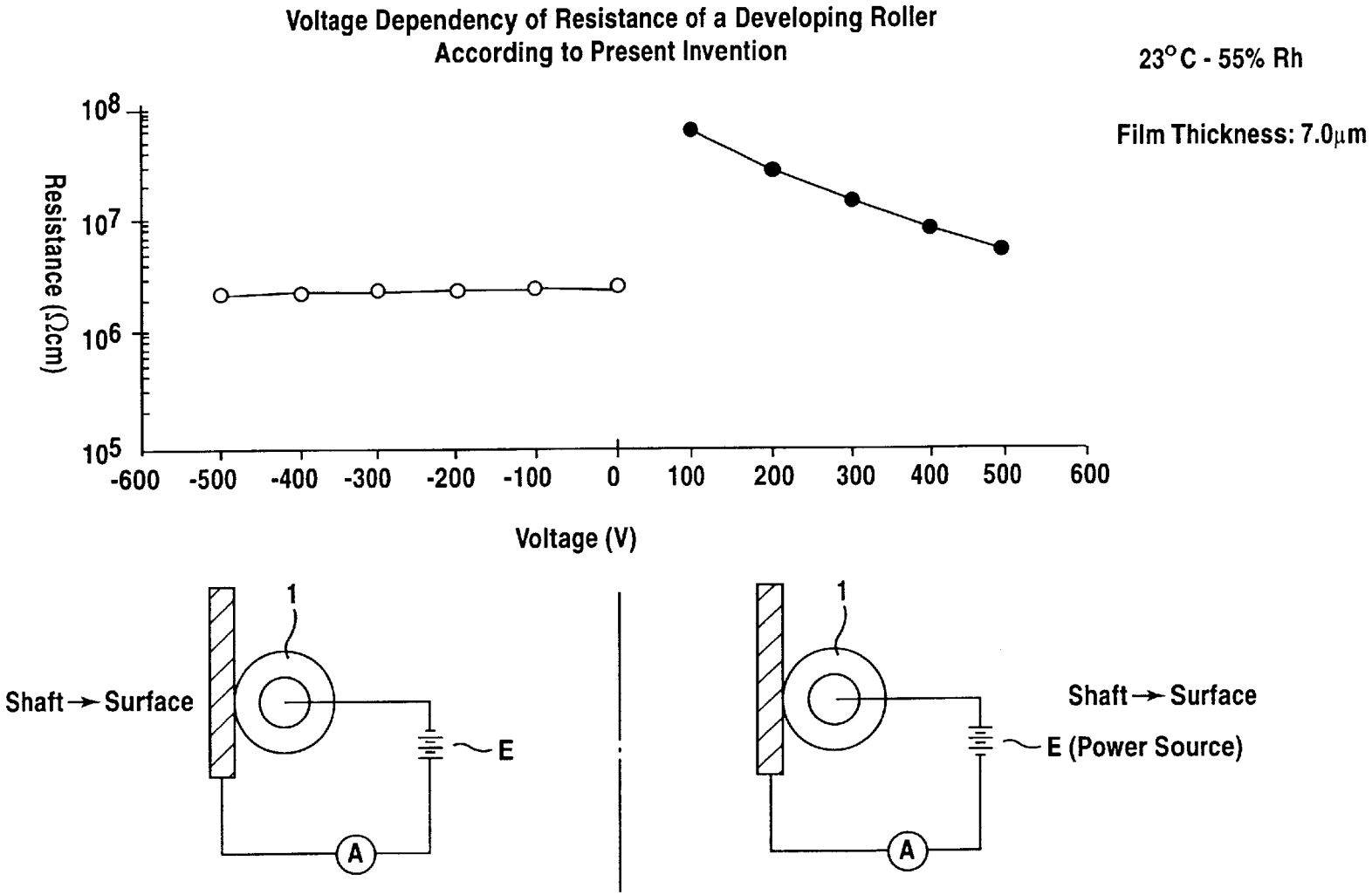
FIG. 4 is a graph illustrating the resistance characteristic of a developing roller according to an embodiment of the present invention.
Figure 5:
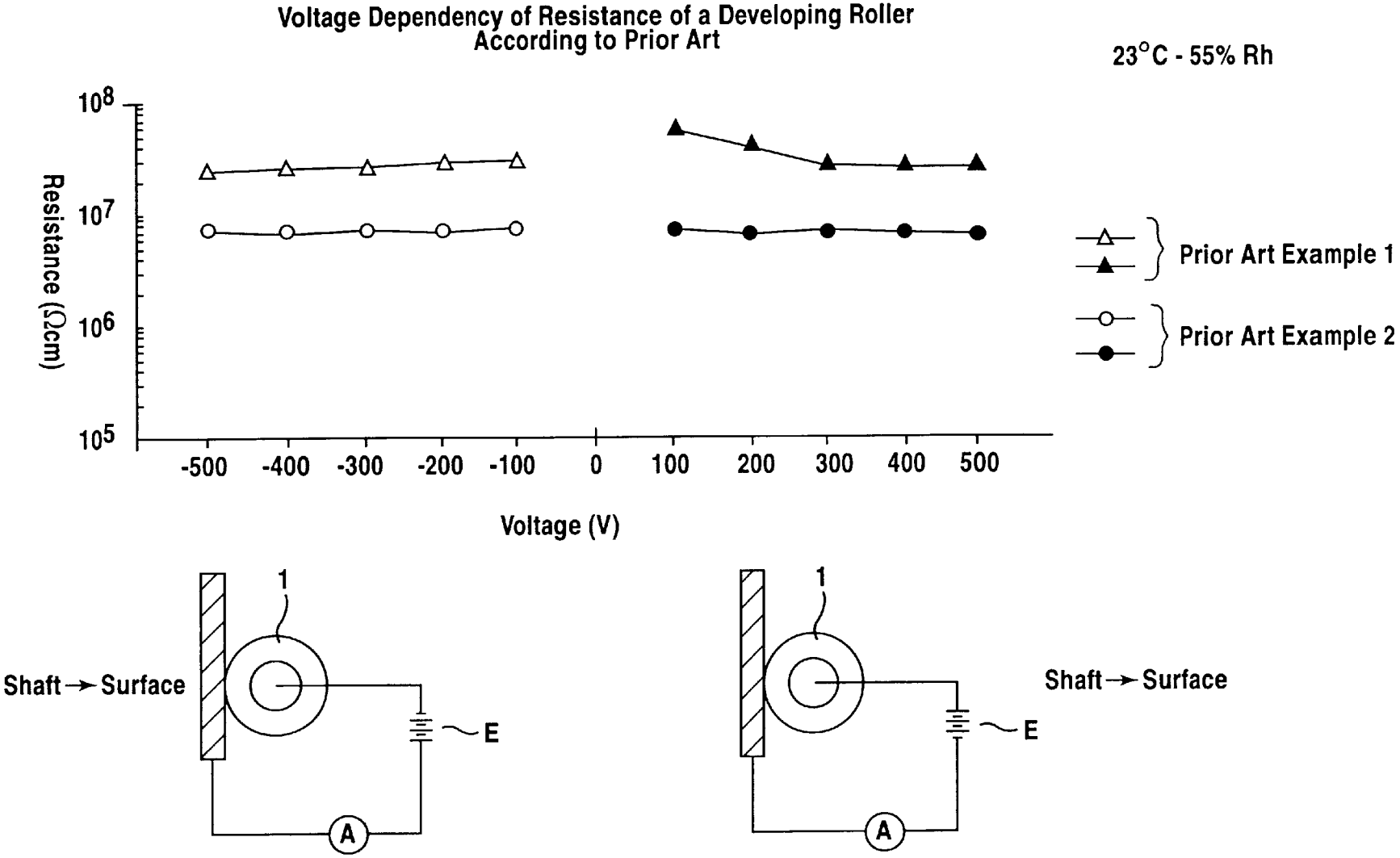
FIG. 5 is a graph illustrating the resistance characteristic of a prior art developing roller.

FIG. 4 is a view showing the resistance characteristic of a developing roller 1 according to an embodiment of the present invention; FIG. 5 is a view showing the resistance characteristic of a prior art developing roller. The points of difference of developing roller 1 according to an embodiment of the present invention and the prior art developing roller will be described by comparing their resistance characteristics and image quality using FIG. 4, FIG. 5 and Table 1 below. In FIG. 4 and FIG. 5, the graphs on the left-hand side of the Figures i.e. with the symbol ○ or Δ represent the case where negative voltage is applied to the side of shaft 1*a* while positive voltage is applied to the side of the surface 1*b* and the graphs on the right-hand side of the Figures i.e. using the symbols ● or ▲ represent the case where the polarity of the voltage is inverted i.e. positive voltage is applied to the side of shaft 1*a* and negative voltage is applied to the side of surface 1*b*.

FIG. 5 shows the resistance characteristic of a prior art developing roller. In prior art example 1, resilient layer 1*c* is NBR rubber, the rubber hardness is 40° (JIS A), and the developing roller surface 1*b* is of JIS 10-point mean roughness 9.5 μm Rz, and its surface is subjected to film processing with polyurethane resin using a spray method to produce a film of 10.0 μm.

Regarding the electrical resistance, when a voltage of −100 V was applied from the side of shaft 1*a* to the side of developing roller surface 1*b*, this was $3.2\times10^7$ Ω·cm and when a voltage of 100 V was applied from the side of developing roller surface 1*b* to the side of shaft 1*a* was $6.4\times10^7$ Ω·cm, $4.5\times10^7$ Ω·cm when 200 V was applied and $3.2\times10^7$ Ω·cm when 300 V was applied; thus, although voltage dependence and current rectifying characteristics were confirmed to be present up to 300 V, above 300 V, as shown by the graph in FIG. 5, there was no voltage dependence nor current rectifying effect.

In prior art example 1, application of voltage of −735 V to the side of photosensitive drum surface 3*b* and −420 V to the side of the developing roller causes charge injection (leakage) of potential difference −315 V, making it impossible for the toner charge to maintain the prescribed amount of charging up and so giving rise to fog as shown in Table 1. Since, even in practice, the difference of the potential of the photosensitive drum surface and the potential of the developing roller surface is −200 V to −450 V, preferably −250 V to −400 V, the problem of fog still remained.

Also, regarding image density, since the resistance fluctuation was increased and there was a considerable increase in resistance at low temperature and low humidity due to setting the resistance of resilient layer 1*c* rather high in order to reduce fog, density was lowered by excessive rise in the amount of charging.

In the case of prior art example 2, with a developing roller prior to performing the surface film treatment of the present invention, resilient layer 1*c* consisted of polyurethane rubber of NCO/OH mol ratio, the so-called index value, of more than "1", the rubber hardness was 45°(JIS A), and the surface roughness of developing roller surface 1*b* was 9.0 μm Rz, no surface film treatment being performed. Regarding the electrical resistance, in the case of application of a voltage of −100 V from the side of shaft 1*a* to the side of developing roller surface 1*b*, this was $6.5\times10^6$ Ω·cm, and in the case of application of voltage 100 V from the side of developing roller surface 1*b* to the side of shaft 1*a* was $6.5\times10^6$ Ω·cm; although the voltage was likewise raised from 200 V to 500 V, as shown by the graph of FIG. 5, no change was found i.e. there was no voltage dependence nor current rectifying characteristic of the resistance.

In the case of prior art example 2, since the frictional charging power was weaker than in the case of prior art example 1 and there was no voltage dependence nor current rectifying capability, toner leakage occurred, resulting in fog as shown in Table 1. Also, since the toner layer potential was low, the image density was rather high.

FIG. 4 shows the resistance characteristic of a developing roller 1 according to an embodiment of the present invention. For resilient layer 1*c* of developing roller 1 of the present invention, a layer of lower resistance than that of resilient layer 1*c* of prior art example 2 described above is employed. Specifically, the polyurethane rubber of resilient layer 1*c* of this developing roller 1 is formed with an index of NCO/OH<1 and is formed with resistance of for example $1.2\times10^6$ Ω·cm; film formation treatment is performed to provide a film of thickness 7.0 μm on the surface by the method of dipping in a liquid in which thermosetting polyurethane is dispersed; it is thereby constituted such that 2<R2/R1<40.

The electrical resistance showed voltage dependence and current rectifying capability, being $2.7\times10^6$ Ω·cm when negative voltage of 100 V is applied to the side of shaft 1*a* and positive voltage to the side of developing roller surface 1*b* but being $6.2\times10^7$ Ω·cm when positive voltage of 100 V is applied to the side of developing roller surface 1*b* and negative voltage to the side of shaft 1*a*, and being $4.2\times10^6$ Ω·cm when 500 V is applied. Also, when the voltage was made progressively larger, as shown in Table 1, there was no occurrence of fog since it was arranged that the ratio (R1/R2) of the resistance (R1) when negative voltage was applied to the side of shaft 1*a* and positive voltage to the side of developing roller surface 1*b* and the resistance (R2) when positive voltage was applied to the side of shaft 1*a* and negative voltage to the side of developing roller surface 1*b* was never less than a minimum value (for example, the value "2").

The current rectifying action will now be described with reference to Table 1 below and FIG. 2. Table 1 shows a comparison of the toner layer potential 4*a* prior to connection of developing roller 1 surface 1*b* with the photosensitive drum surface 3*b* of FIG. 2 and the toner layer potential 4*b* after connection.

In the case of prior art example 1 and prior art example 2, the potential 4*b* of the toner layer after connection fell compared with the potential of the toner layer prior to connection with photosensitive drum surface 3*b*, giving rise to fog. In contrast, with the embodiment of the present invention, the potential 4*b* of the toner layer after connection rose compared with the toner layer potential 4*a* prior to connection with the photosensitive drum surface 3*b*, so there was no occurrence of fog.

The reason why fog occurs notwithstanding the fact that both the toner layer potential 4*a* prior to contact with photosensitive drum surface 3*b* of prior art example 1 and the toner layer potential 4*b* after contact therewith have higher values than in the case of the embodiment is that, although the toner layer potential is apparently high, since it is subject to the effect of leakage, uncharged toner and/or non-uniform toner become mixed therewith, giving rise to considerable variability of the amount of charge of the charging-up, resulting in the production of fog. The effect of leakage can be seen from the large drop in toner layer potential 4*b* after contact.

In contrast, the reasons why fog does not take place in the embodiment are as follows. Specifically, as described above, since there is a resistance characteristic (current rectifying characteristic) that makes current flow positively at the side of developing roller surface 1*b* and negatively at the side of shaft 1*a* difficult, when photosensitive drum surface 3*b* and developing roller surface 1*b* come into contact, on the contrary, the toner is in fact further charged up by the charge injection action. Consequently, by utilizing this characteristic, the amount of charging up of the toner on developing roller 1 is stabilized, enabling an image of high quality without fog to be obtained. Also, as can be seen from Table 1, since there is little fluctuation of resistance due to the temperature or humidity of the environment, there is little fluctuation of toner layer potential, so the density is also stable.

TABLE 1

| Developing roller sample | Temperature -humidity | Resistance $R_1$ (Ω.cm) | Resistance $R_2$ ((Ω.cm) | Toner layer potential 4a | Toner layer potential 4b | Density (O.D.) | Fog (O.D.) |
|---|---|---|---|---|---|---|---|
| Prior art | 5° C.-20% Rh | $2.8 \times 10^8$ | $1.1 \times 10^9$ | −77 V | −72 V | 1.36 | 0.02 |
| Example 1 | 23° C.-55% Rh | $3.2 \times 10^7$ | $6.4 \times 10^7$ | −48 V | −43 V | 1.43 | 0.05 |
| | 35° C.-80% Rh | $2.9 \times 10^6$ | $3.1 \times 10^6$ | −31 V | −21 V | 1.49 | 0.08 |
| Prior art | 5° C.-20% Rh | $2.8 \times 10^7$ | $9.6 \times 10^7$ | −43 V | −38 V | 1.46 | 0.04 |
| Example 2 | 23° C.-55% Rh | $6.5 \times 10^6$ | $6.5 \times 10^6$ | −30 V | −24 V | 1.47 | 0.12 |
| | 35° C.-80% Rh | $8.1 \times 10^5$ | $8.7 \times 10^5$ | −23 V | −12 V | 1.48 | 0.24 |
| Embodiment | 5° C.-20% Rh | $3.5 \times 10^7$ | $1.4 \times 10^9$ | −63 V | −66 V | 1.33 | 0.00 |
| | 23° C.-55% Rh | $2.3 \times 10^6$ | $6.2 \times 10^7$ | −50 V | −52 V | 1.40 | 0.00 |
| | 35° C.-80% Rh | $1.0 \times 10^6$ | $4.1 \times 10^6$ | −38 V | −39 V | 1.45 | 0.00 |

Note) In the case of resistance R1, the applied voltage was −100 V, and in the case of resistance R2 the applied voltage was 100 V. The toner layer thickness on the developing roller was 8 μm.

Figure 6:
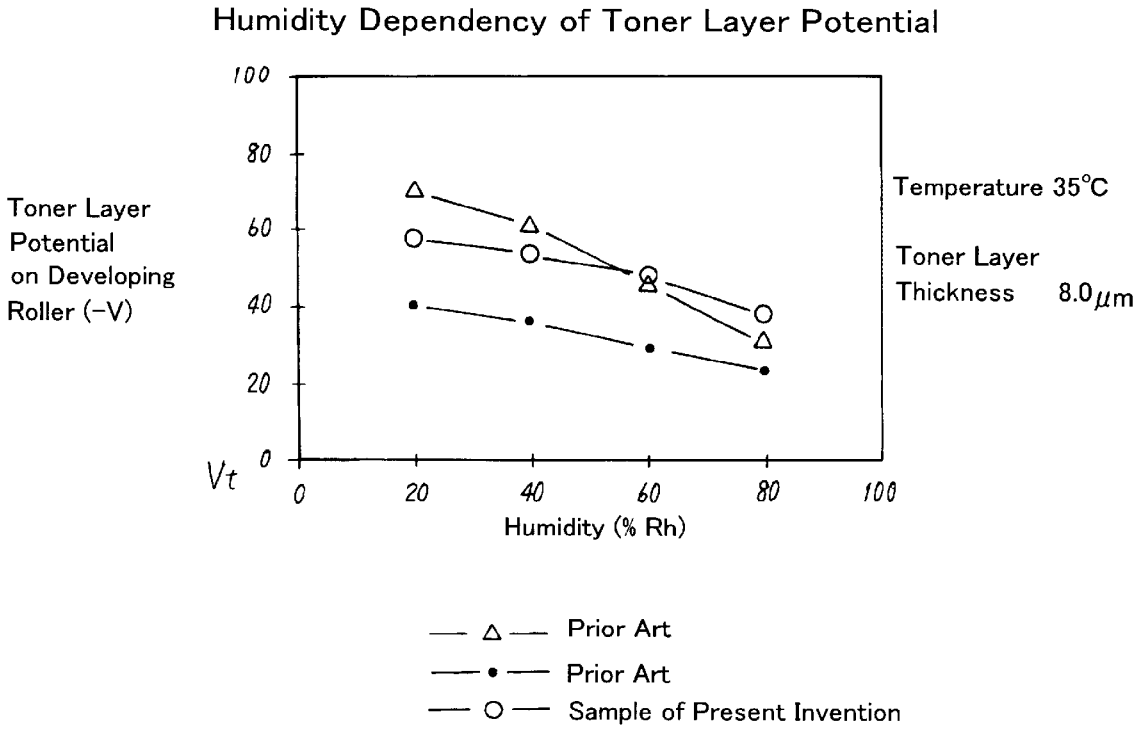
FIG. 6 is a graph illustrating the humidity dependence of the toner layer potential on a developing roller.
Figure 7:
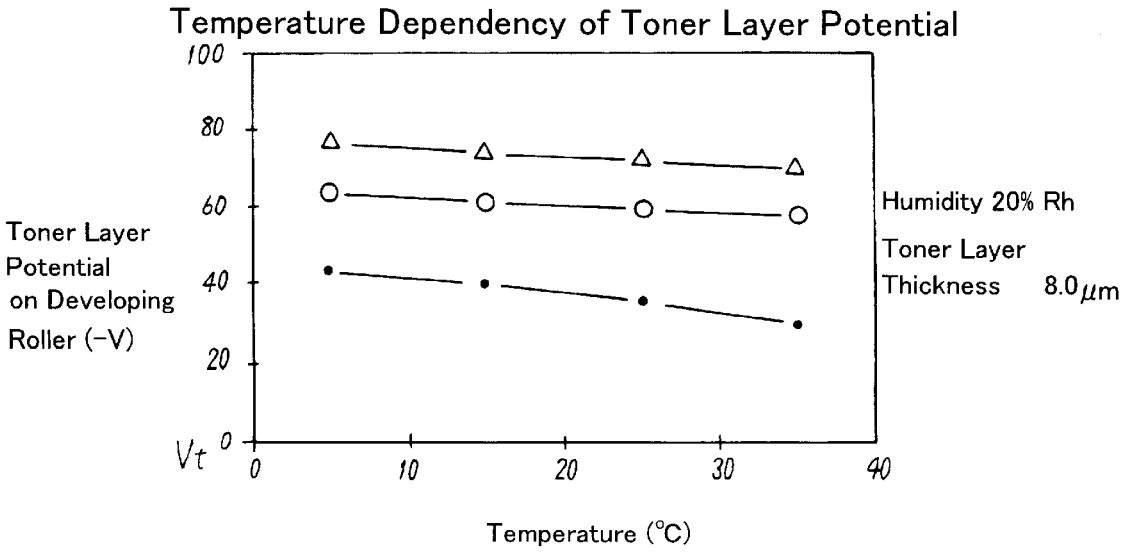
FIG. 7 is a graph illustrating the temperature dependence of the toner layer potential on a developing roller.

Next, the environmental characteristics of developing roller 1 of the present invention are described using FIGS. 6 to 11. The data of FIGS. 6 to 11 were collected under identical conditions, changing only the developing roller. In FIG. 6 and FIG. 7, the data of the toner layer potential 4*a* (4*b*) (hereinbelow referred to as "Vt") on the developing roller were measured using a non-contact probe and surface potentiometer after setting the toner layer thickness to 8.0 μm and forcibly disconnecting the image forming apparatus from the apparatus during white block printing. Also, FIG. 6 shows the results of investigating dependence of toner layer potential 4*a* on the developing roller on humidity, the temperature being fixed at 35° C. As shown in FIG. 6, in the embodiment, the way in which Vt falls is more gradual than in the case of prior art example 1, from which it can be said that the amount of charging up is stable with respect to humidity. Also, it can be seen that Vt shows relatively higher values than prior art example 2.

FIG. 7 shows the results of examining the dependence of toner layer potential 4*a* on the developing roller on temperature, the humidity being kept fixed at 20% Rh. As shown in FIG. 7, the Vt of the embodiment is relatively lower than in the case of prior art example 1 and shows higher values than prior art example 2.

Figure 8:
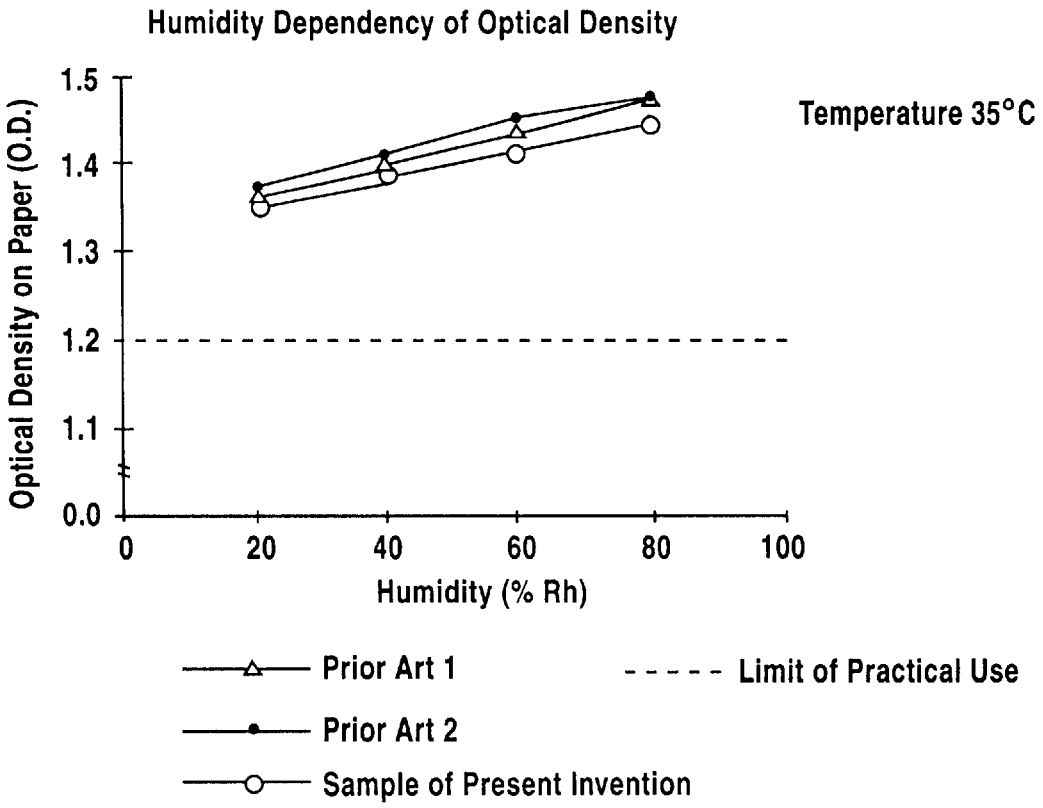
FIG. 8 is a graph illustrating the humidity dependence of optical density on the paper.
Figure 9:
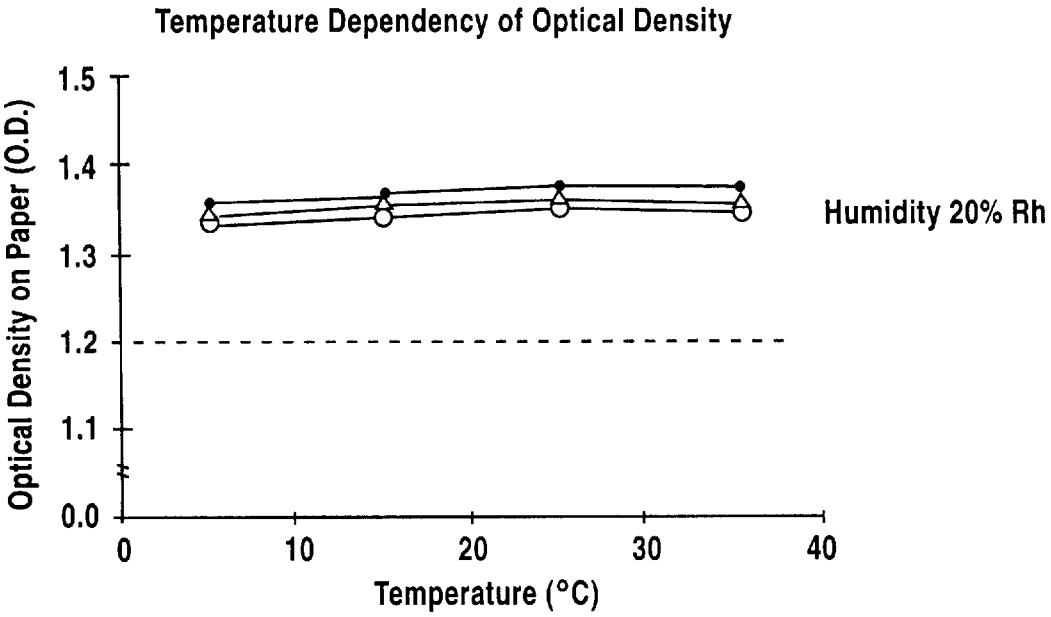
FIG. 9 is a graph illustrating the temperature dependence of optical density on the paper.

Like FIG. 6 and FIG. 7, FIG. 8 shows the results of examining the dependence of the optical density (O.D.) on the paper on humidity, the temperature being kept fixed at 35° C. FIG. 9 shows the results of examining the dependence of optical density on the paper on temperature, the humidity being kept fixed at 20% Rh. Although, as shown in FIG. 8, in none of the embodiment, prior art example 1, or prior art example 2 is there a relative difference in regard to temperature, in regard to humidity, it can be seen that density rises as humidity increases. This is because, as shown in FIG. 6, when the humidity rises, Vt drops, causing the charging-up charge level to decrease, thereby increasing the amount of toner that adheres to the electrostatic latent image and so raising its density.

Figure 10:
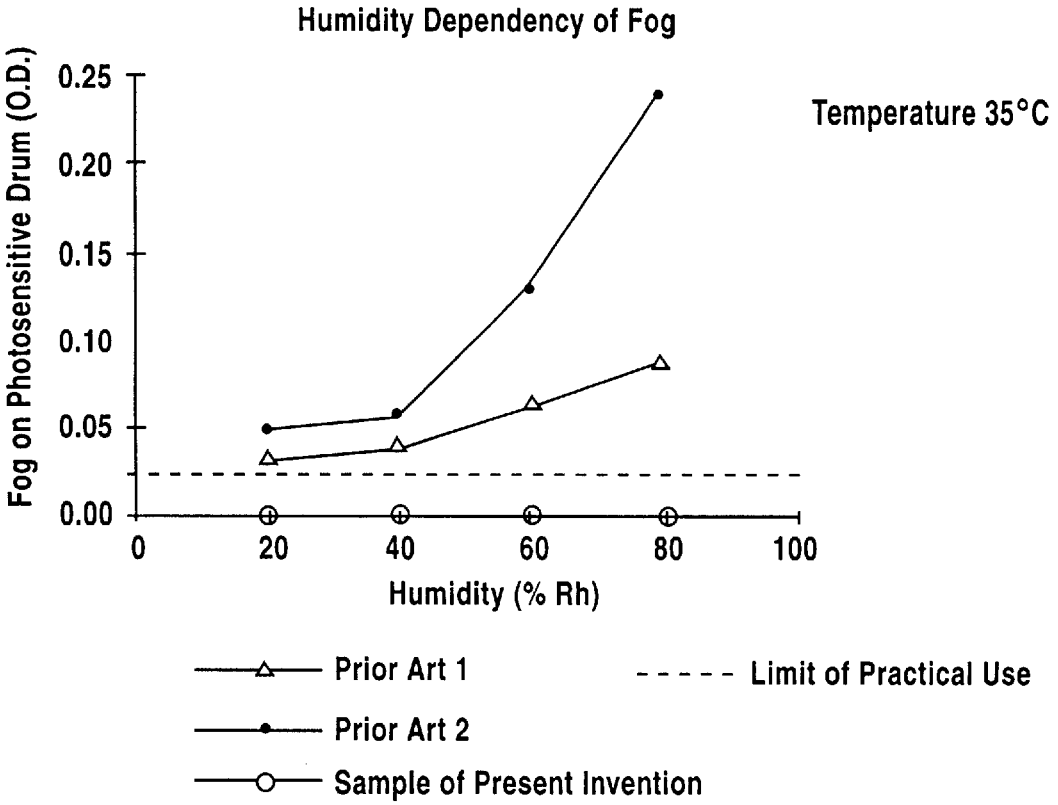
FIG. 10 is a graph illustrating the humidity dependence of fog on a photosensitive drum.
Figure 11:
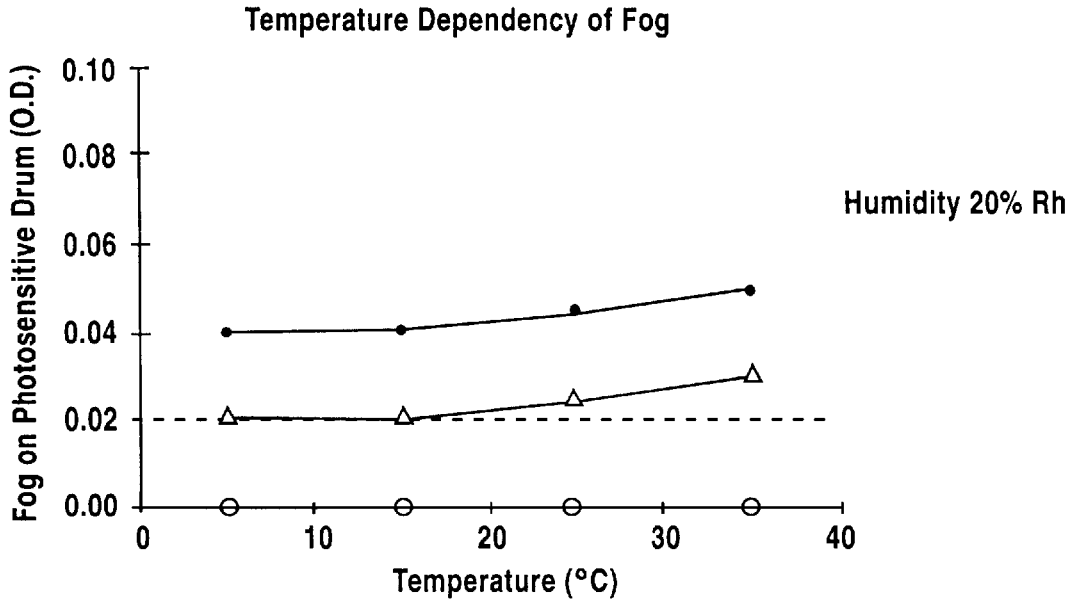
FIG. 11 is a graph illustrating the temperature dependence of fog on a photosensitive drum.

Likewise, FIG. 10 shows the results of examining the dependence of fog on photosensitive drum 3 on humidity, temperature being kept fixed at 35° C. FIG. 11 shows the results of examining the dependence in respect of fog of photosensitive drum 3, humidity being kept fixed at 20% Rh. As shown in FIG. 10 and 11, in the case of the embodiment fog was not produced by temperature or humidity but in both prior art example 1 and prior art example 2 it can be seen that the fog exceeded the limit for practical use of an optical density O.D. value of 0.02. A description regarding the fog of FIG. 10 and FIG. 11 will now be given using FIG. 6 and FIG. 7. As shown in FIG. 6 and FIG. 7, the Vt of the embodiment shows a value that is lower than that of prior art example 1 but higher than that of prior art example 2. It can be seen that the reason why prior art example 1 displays fog even though it has a higher Vt (toner layer potential 4*a*) than the embodiment is that the amount of charging up of the toner is lowered by leakage current between photosensitive drum surface 3*b* and developing roller surface 1*b* as described above.

Figure 12:
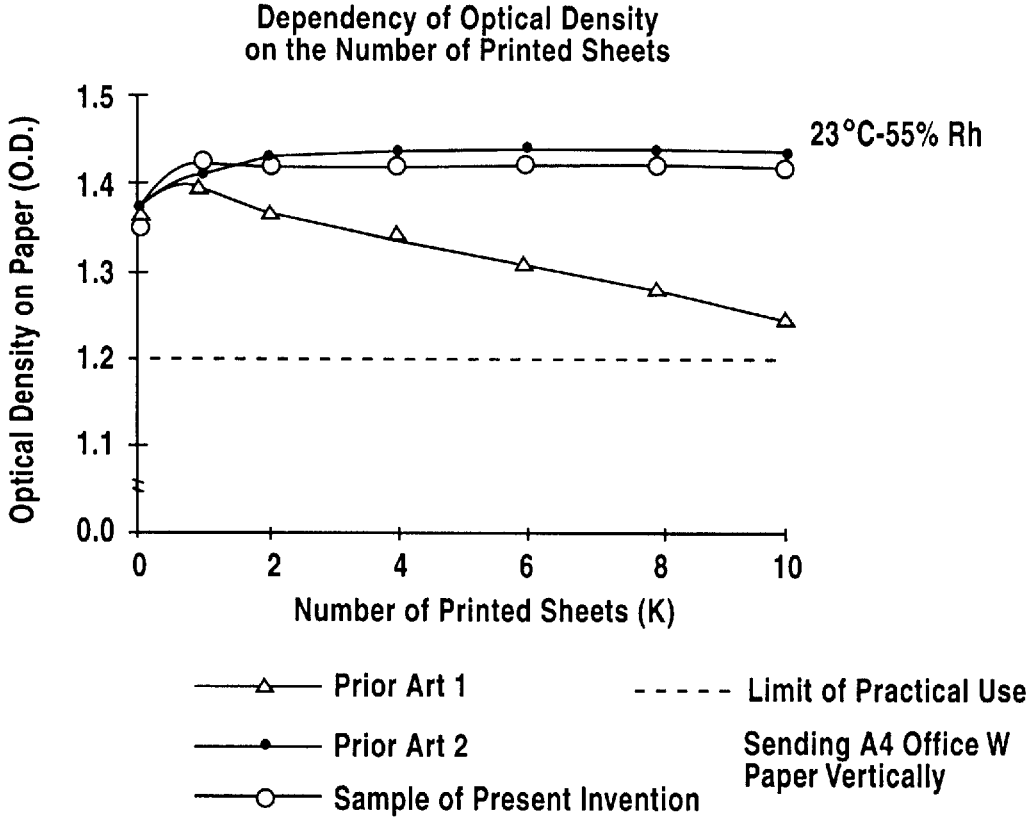
FIG. 12 is a graph illustrating the dependence on number of printed sheets of the toner layer potential on a developing roller.

Next, the stability of developing roller 1 in the embodiment of the present invention will be described with reference to FIG. 12 to FIG. 14. FIG. 12 represents an investigation of the dependence of optical density (O.D.) on the paper on the number of printed sheets; although there is no difference between the embodiment, prior art example 1 and prior art example 2 as regards the initial density, in the case of prior art example 1, although the O.D. value of the density temporarily rises, as printing is repeated, the density falls. Contrariwise, in the embodiment and prior art example 1, as printing is repeated, the density gradually rises. This result can be understood as a tendency for Vt to drop as repeated printing is continued, as shown in FIG. 12. In the embodiment and prior art example 2, due to deterioration of the toner, the amount of charge decreases, causing an increase in the amount of toner adhering to the electrostatic latent image and so raising its density. The case of prior art example 1 is the same, but since this surface film is hard and is made rather thick in order to avoid contamination of the photosensitive drum, fine toner powder is melted, adhering to the developing roller and causing filming. As a result, adhesion of toner to the developing roller surface becomes difficult, leading to the production of a large number of white dots in the image and to vertical white streaks, lowering the density.

Figure 13:
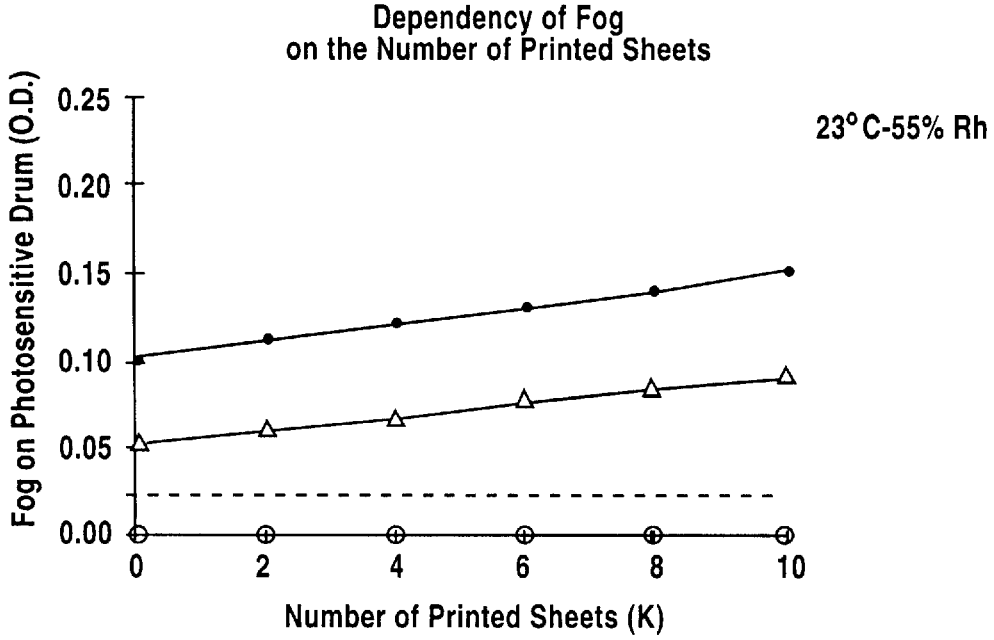
FIG. 13 is a graph illustrating the dependence on number of sheets printed of the optical density on the paper.
Figure 14:
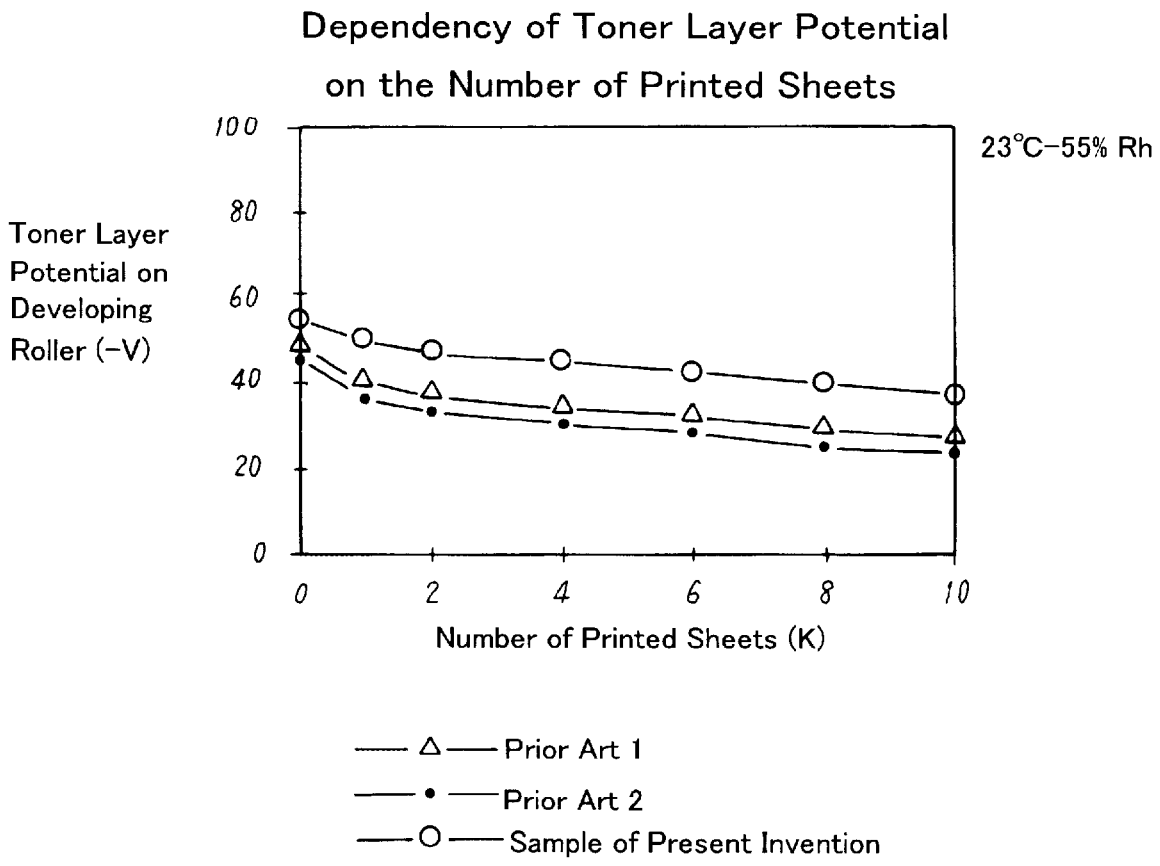
FIG. 14 is a graph illustrating the dependence on number of sheets printed of the fog on a photosensitive drum.

FIG. 13 represents an investigation of dependence of fog on number of printed sheets; although in the embodiment fog with increase in the number of printed sheets does not arise, in the case of prior art example 1 and prior art example 2 the O.D. value of fog gradually rises as printing is continued. This is for the following reason. Specifically, as shown in FIG. 14, Vt drops as printing is continued. In the embodiment, even if Vt falls due to deterioration of the toner, since fog due to leakage as described above does not occur, a slight drop in Vt does not give rise to fog. In the case of prior art example 1 and prior art example 2, when Vt drops, there is a sensitive reaction in respect of leakage, resulting in a gradual rise in the O.D. value of fog as printing is continued.

Next, the material of resilient layer 1*c* and surface 1*b* of developing roller 1 will be described. Resilient layer 1*c* comprises hydroxyl groups (OH) and isocyanate groups (NCO). Their mol ratio NCO/OH is made <1. Also, surface 1*b* is designed such that its volume resistivity is in a prescribed range ($1\times10^8$ to $10^{12}$ Ω·cm). To achieve this, the film thickness of surface 1*b* is formed as 4 to 16 μm. By this means, the relationship $2<R1/R2<40$ is obtained. Examples of materials whereby such volume resistivity of surface 1*b* can be obtained include resins such as polyurethane, epichlorohydrin, NBR, or CR etc., or esteramase etc. These may be employed in solvent dilution, latex, or emulsion mode etc.

If the volume resistivity is lower than the above prescribed range i.e. $R1/R2\leqq2$, or further if $R1\approx R2$ is approached, the buffer effect is lost, and reverse charging from photosensitive drum 3 occurs. Also, if the volume resistivity is higher than the above prescribed range i.e. if $R1/R2\geqq40$, the electrical resistance of the toner carrier shows an extreme rise, as a result of which it becomes incapable of performing the function of a toner carrier.

Thus, the reasons for forming the film thickness of the surface film of developing roller 1 at 4 to 16 μm are in order to stabilize printing quality by making the film of the necessary thickness at the surface in order to obtain stable printing density and to obtain the necessary resistance characteristic (current rectifying capability) of developing roller 1 in order to provide a countermeasure against leakage current from the photosensitive drum, which is a cause of fog.

Figure 15:
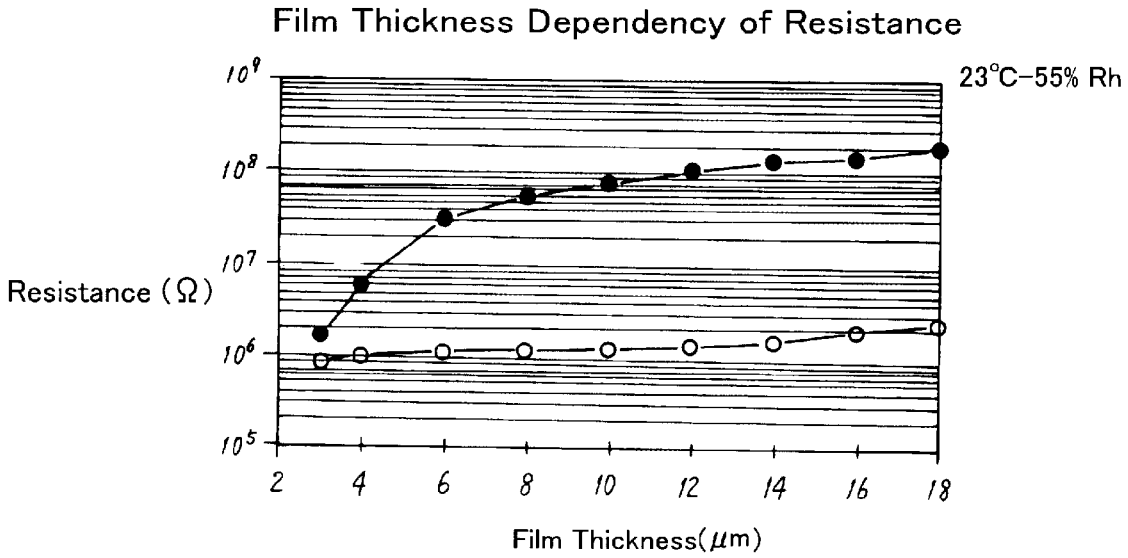
FIG. 15 is a graph illustrating the dependence on film thickness of the surface film of the resistance.
Figure 15:
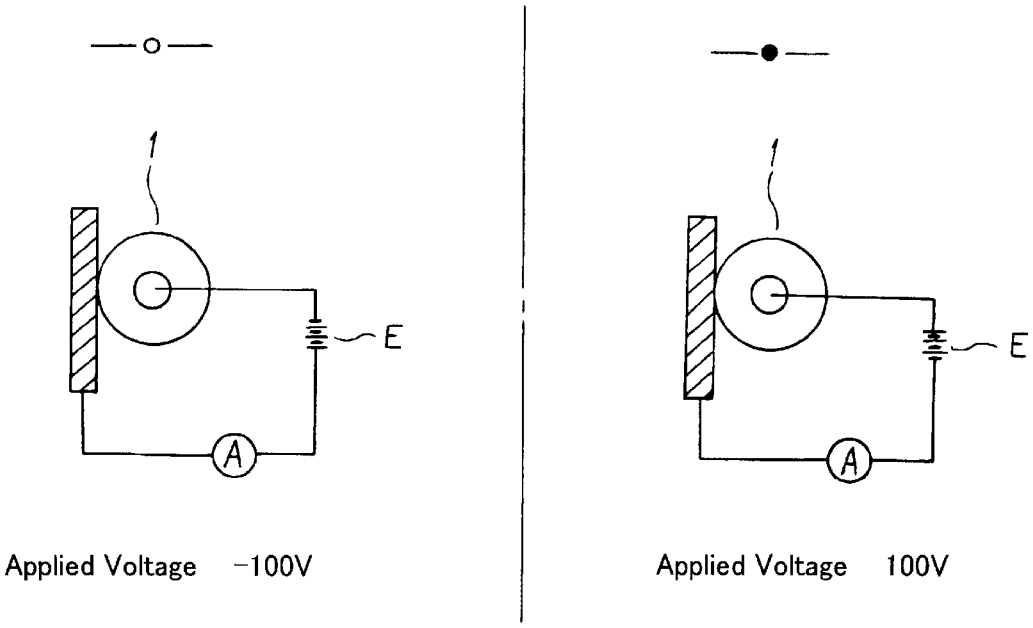

FIG. 15 is a view showing the film thickness dependence of the resistance. As shown in FIG. 15, if the surface film thickness is formed less than 3 μm, the resistance from the surface in the direction of the shaft and the resistance from the shaft in the direction of the surface approach each other i.e. it can be seen that the current rectifying capability is lost.

Figure 16:
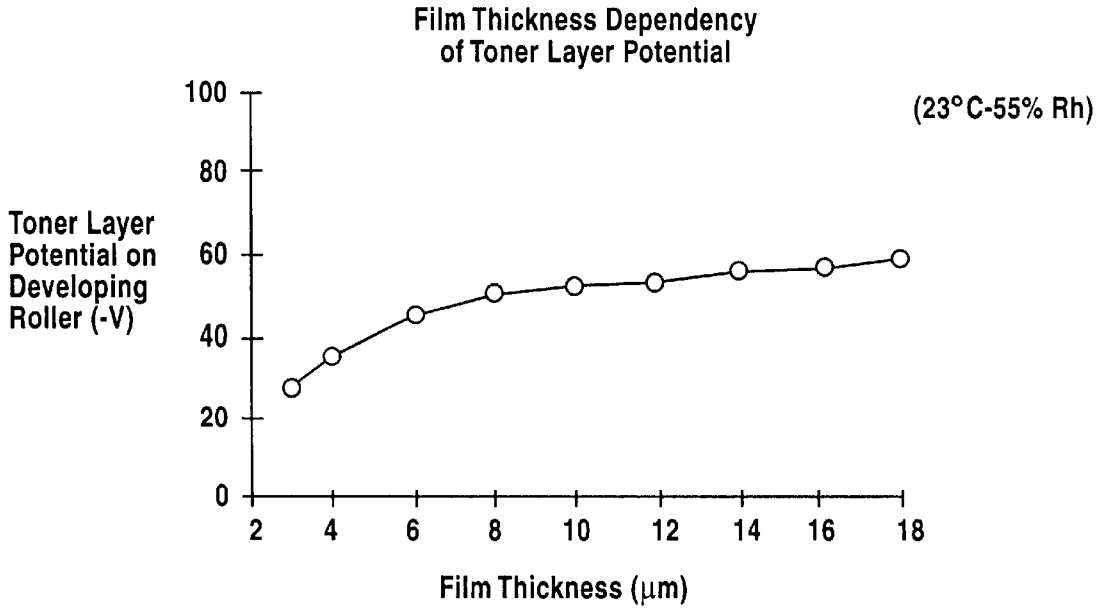
FIG. 16 is a graph illustrating the dependence on film thickness of the toner layer potential on a developing roller.

FIG. 16 is a view showing the film thickness dependence of toner layer potential on the developing roller. When the surface is formed with thickness of under 3 μm, the toner layer potential drops. Thus, comparing the toner layer potential 4*a* prior to contacting of photosensitive drum surface 3*b* and developing roller surface 1*b* with the toner layer potential 4*b* after contacting, if this is formed at under 3 μm, the toner layer potential 4*b* after contact drops compared with the toner layer potential 4*a* prior to contact; contrariwise, if this is made more than 4 μm, the toner layer potential 4*b* after contact rises compared with the toner layer potential 4*a* prior to contact. Also, if the film thickness becomes large, the toner layer potential difference widens further; this is particularly marked in high-temperature high-humidity environments.

Table 2 shows the results of investigating the film thickness dependence of image sharpness and image missing. In Table 2, image sharpness becomes bad and image missing is produced at film thickness of more than 18 μm.

TABLE 2

| Film thickness (μm) | 4 | 6 | 8 | 10 | 12 | 14 | 16 | 18 |
|---|---|---|---|---|---|---|---|---|
| Image sharpness (visual) | ○ | ○ | ○ | ○ | ○ | ○ | ○ | x |
| Image missing (visual) | ○ | ○ | ○ | ○ | ○ | ○ | ○ | x |

Note) ○: good x: no good

Figure 17:
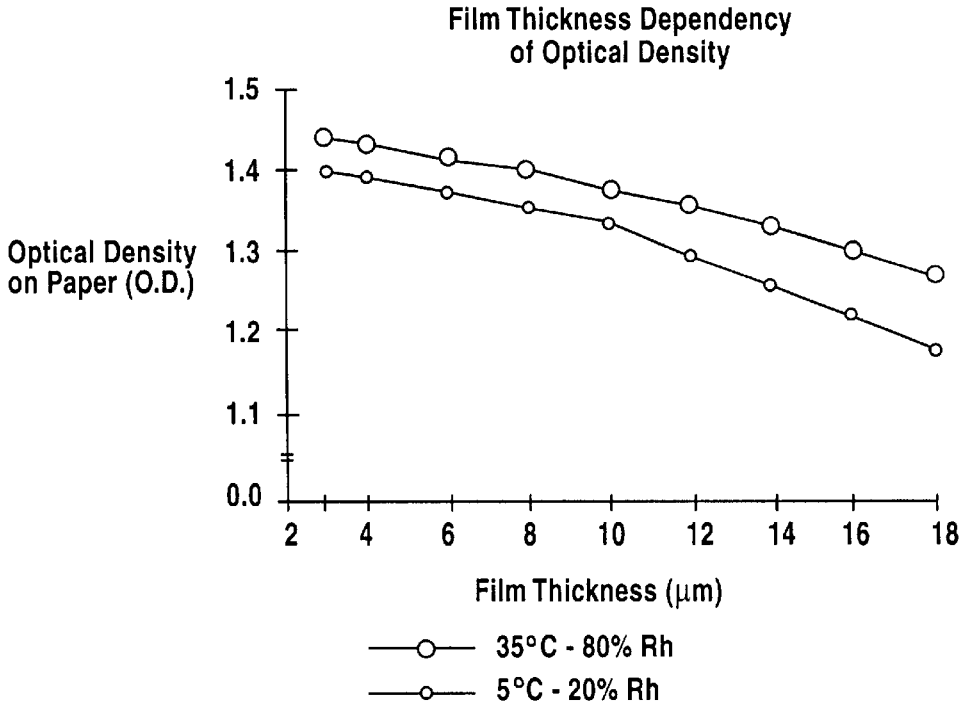
FIG. 17 is a graph illustrating the dependence on film thickness of the surface film of the optical density on the paper.

FIG. 17 is a view showing the film thickness dependence of optical density on the paper. In FIG. 17, as the film thickness is made greater, the optical density (O.D.) drops and as the film thickness is made less, the optical density rises until at 18 μm or thereabove the practically preferred density O.D. of 1.20 or below is reached. Since the resistance from the shaft 1*a* to the surface is not rising, this phenomenon is not due to the resistance but is due to the film thickness.

Figure 19:
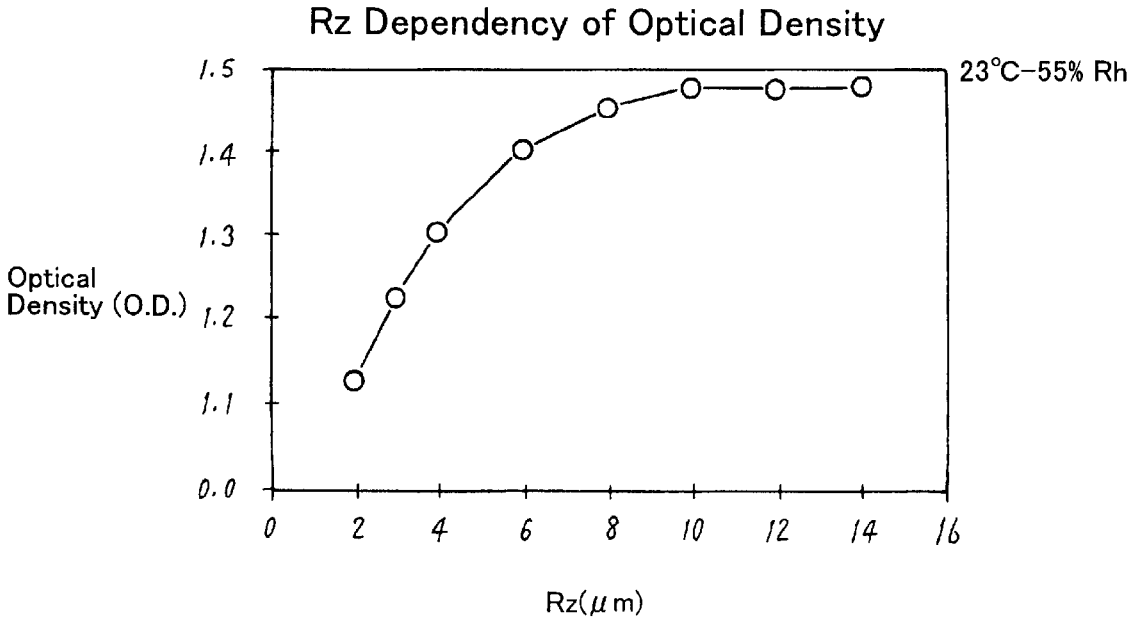
FIG. 19 is a graph illustrating the dependence on surface roughness of the optical density on the paper.

Hereinbelow the fact that film thickness is the causative factor will be explained with reference to FIG. 19, FIG. 20, FIG. 21, FIG. 22 and FIG. 23. FIG. 19 is a view showing the surface roughness dependence of optical density on the paper. In FIG. 19, the density on the paper increases since the conveying force rises as the amount of toner adhering to the developing roller surface 1*b* increases, due to the surface irregularities of developing roller 1 becoming larger as the surface roughness increases.

Figure 20:
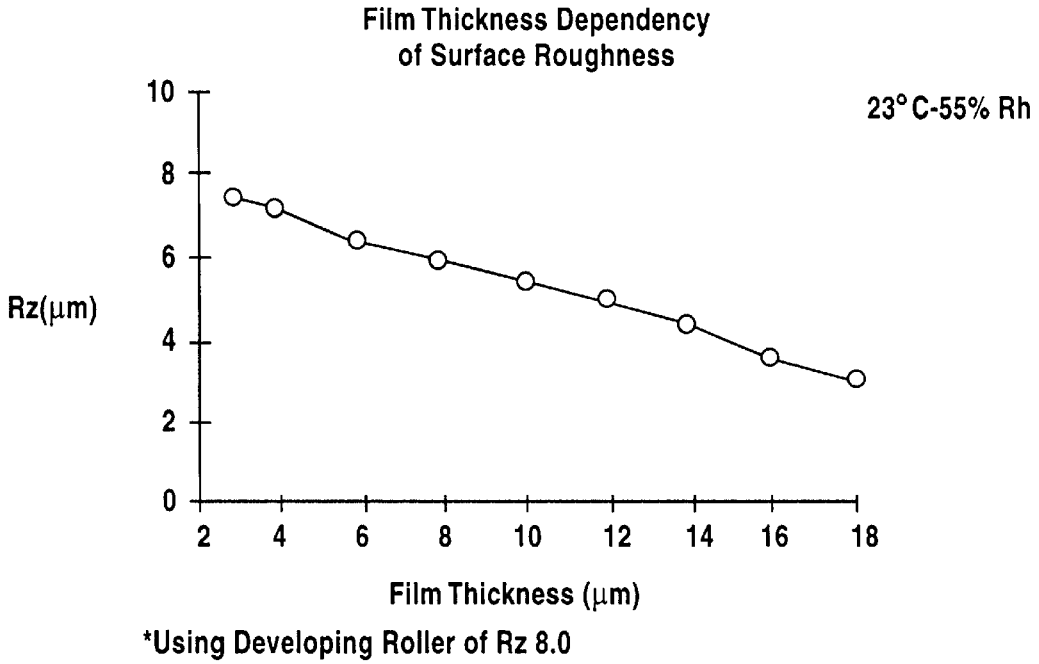
FIG. 20 is a graph illustrating the dependence on film thickness of the surface film of the surface roughness Rz.

FIG. 20 is a view showing the film thickness dependence of surface roughness. In FIG. 20, regarding surface roughness, the value of the surface roughness gets smaller as the film thickness increases, due to surface irregularities becoming fewer due to the increasing film thickness.

Figure 21:
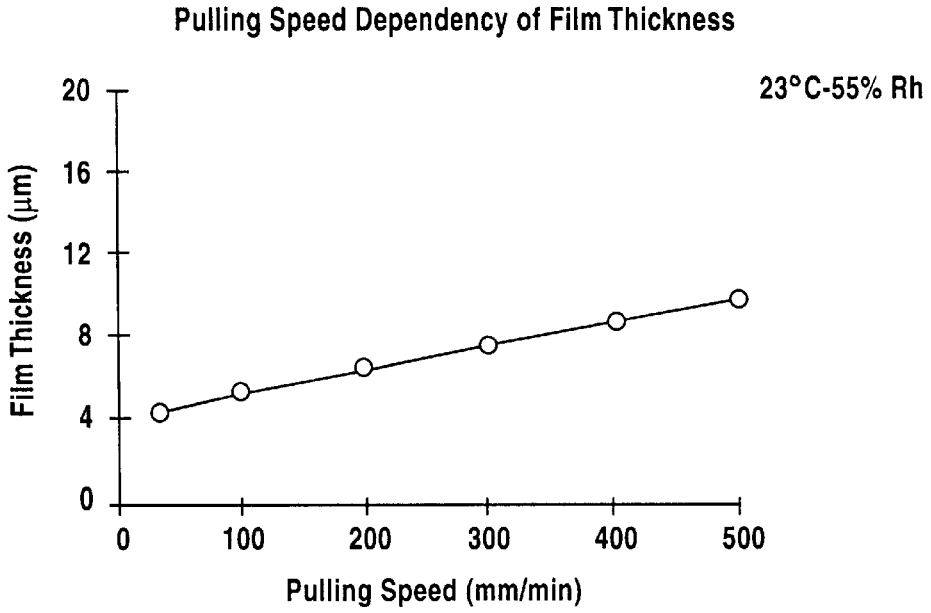
FIG. 21 is a graph illustrating the dependence on pulling speed of the film thickness of the surface film.

FIG. 21 is a view showing the pulling speed dependence of film thickness. In FIG. 21, regarding film thickness, film thickness is increased by the time for which the solution adheres to the surface 1*b* of developing roller 1 becoming longer due to increase in the pulling speed of developing roller 1.

Figure 22:
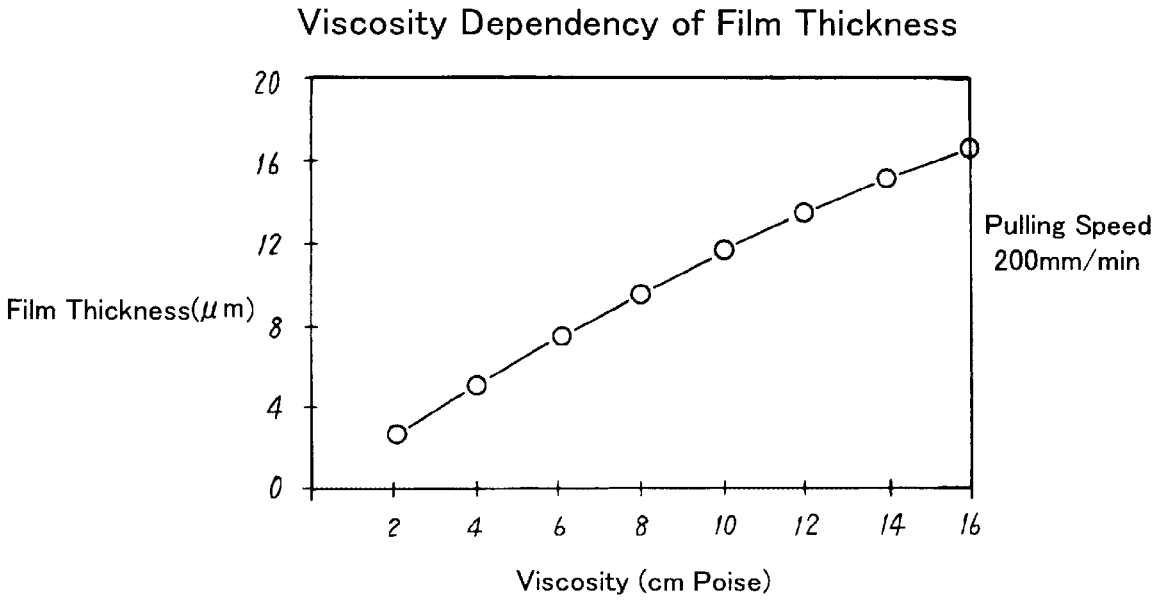
FIG. 22 is a graph illustrating the dependence on liquid viscosity of the film of the surface film.

FIG. 22 is a view showing the viscosity dependence of film thickness. In FIG. 22, film thickness increases due to the adhesive force on to surface irregularities of developing roller 1 becoming stronger as the viscosity increases.

Figure 23:
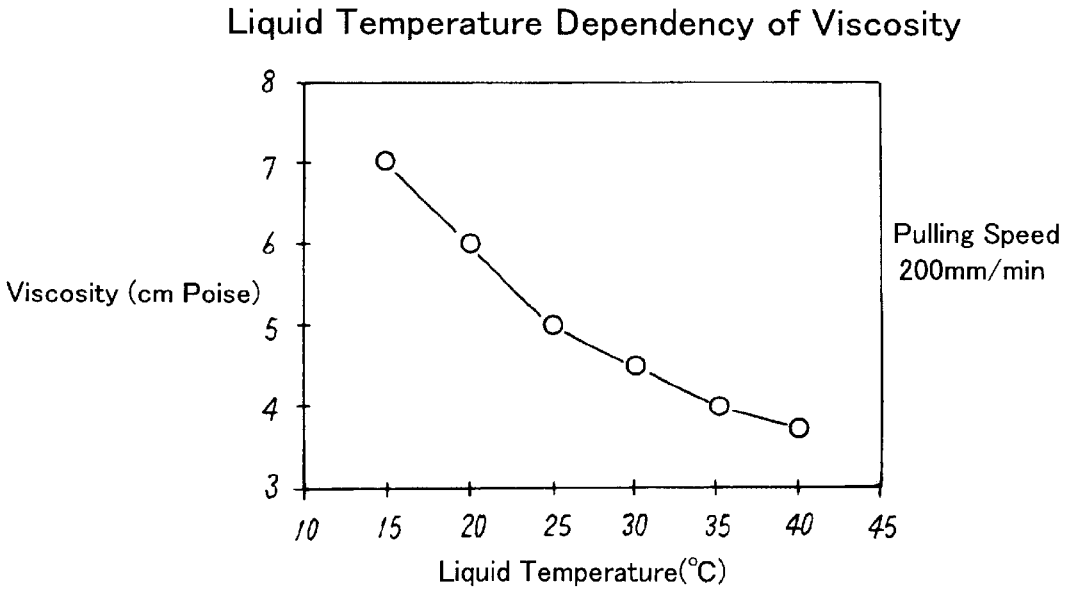
FIG. 23 is a graph illustrating the dependence on liquid temperature of the liquid viscosity.

FIG. 23 is a view showing the liquid temperature dependence of viscosity. In FIG. 23, the viscosity falls due to the resin of the solution becoming softer when the liquid temperature is increased.

As described above with reference to FIG. 19 to FIG. 23, apart from the resistance of the developing roller 1, as can be seen from FIG. 20, printing density is greatly affected by surface irregularity of the developing roller and the prescribed surface roughness prior to coating must be maintained after coating also. Consequently, in order to control the surface roughness after coating, a prescribed film thickness is necessary. In order to obtain this film thickness, as can be seen from FIG. 21 and FIG. 22, a prescribed pulling speed and control of the liquid viscosity are necessary. Also, as can be seen from FIG. 23, liquid temperature control is important in regard to viscosity.

The film thickness dependence of image destruction and image missing shown in Table 2 and the drop in printing density occur because the surface roughness becomes smaller in the process whereby the film thickness is increased, as can be understood from the above description.

Figure 18:
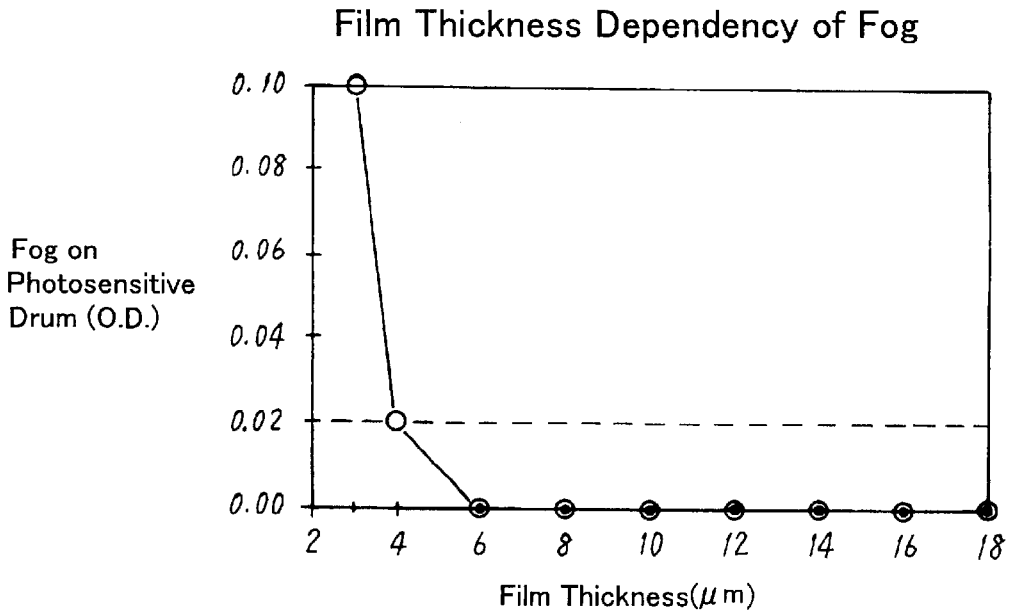
FIG. 18 is a graph illustrating the dependence on film thickness of the surface film of fog on a photosensitive drum.

FIG. 18 shows the film thickness dependence of fog on the photosensitive drum. In FIG. 18, when the film thickness is increased, fog decreases and when the film thickness is reduced fog increases. This is because the resistance from the surface to the shaft decreases, fog being generated by a drop of the charging amount of the toner below the prescribed charging amount, due to loss of charge caused by the toner 4 receiving leakage current between photosensitive drum 3 and developing roller 1. Specifically, this is because the film thickness of developing roller 1 has diminished; as can be seen in FIG. 15, below 3 μm, the resistance from surface to shaft shows a considerable drop, approaching the resistance from shaft to surface, because the current rectifying capability of the resistance is lost.

Consequently, as will be clear from the above description, in regard to fog, the film thickness of the surface 1*b* of developing roller 1 should be formed of thickness at least 4 μm and even more preferably should be formed of thickness at least 5 μm. Also, with regard to density, the film thickness of surface 1*b* of developing roller 1 should be formed of no more than 16 μm and even more preferably formed of no more than 14 μm. In this way, stable printing density and high printing quality with no fog can be realized.

Next, a description will be given in regard to surface roughness (Rz) using FIG. 19 and Table 3. In the surface 1*b* of developing roller 1, the surface roughness is formed at 0.4 to 1.5 times the mean grain size of the non-magnetic single-component toner.

TABLE 3

| Mean grain size of toner (μm) | Multiplication factor of mean grain size | Surface roughness (Rz) (μm) | Density (O.D.) | Fog (O.D.) | Presence of image missing (visual) due to surface roughness |
|---|---|---|---|---|---|
| 7.5 | × 0.3 | 2.3 | 1.15 | 0.00 | Yes |
| 7.5 | × 0.4 | 3.0 | 1.25 | 0.00 | No |
| 7.5 | × 1.5 | 11.3 | 1.48 | 0.00 | No |
| 7.5 | × 1.6 | 12.0 | 1.46 | 0.00 | Yes |
| 9.0 | × 0.3 | 2.7 | 1.18 | 0.00 | Yes |
| 9.0 | × 0.4 | 3.6 | 1.26 | 0.00 | No |
| 9.0 | × 1.5 | 13.5 | 1.48 | 0.00 | No |
| 9.0 | × 1.6 | 14.4 | 1.45 | 0.00 | Yes |

From FIG. 19, the density on the paper increases because, when the surface roughness Rz gets larger, the surface irregularity rough faces of developing roller 1 become larger, causing the amount of toner adhering to developing roller surface 1*b* to become larger, raising the conveying force. In view of the allowed value of the density for practical use, it is found that the surface roughness (Rz) must be at least 3.0 μm.

From Table 3, when toner of grain size 7.5 μm is employed, if the surface roughness (Rz) is more than 3.0 μm and below 11.3 μm, the allowed values for practical use in respect of density and image missing are satisfied but, at more than 12.0 μm, missing of the image due to surface roughness occurs and at below 2.3 μm decrease of surface roughness causes a drop in the amount of toner adhering to the developing roller surface 1*b*, lowering the conveying force and so lowering the density and therefore giving rise to image missing. Furthermore, likewise in the case where toner of 9.0 μm was employed, for surface roughness (Rz) of more than 3.0 μm but less than 13.5 μm, the allowed values for practical use of density and fog are satisfied, but, above 14.4 μm, missing of the image due to surface roughness occurs, and below 2.7 μm missing of the image due to lowered density occurs.

Consequently, by forming the irregular rough faces of surface 1*b* of developing roller 1 at 0.4 to 1.5 times the mean grain size of the non-magnetic single-component toner, a high-quality image can be provided having stable density and with no image missing produced by surface roughness and/or lowered density.

Next, a method of manufacturing a developing roller 1 according to an embodiment of the present invention will be described. A resilient layer 1*c* of semiconductive polyurethane rubber was employed at the circumference of a conductive shaft 1*a*[JG-S626(SUS430)]. The rubber hardness was 40° (JIS A); the developing roller surface 1*b* had a surface roughness (Rz) of 7 μm obtained by finishing performed by finisher processing of the irregular rough faces after grinding (finishing performed by bringing sandpaper into contact therewith and rotating developing roller 1 in the radial direction).

Next, in the same way as before processing, the electrical properties of this developing roller 1 were investigated in a location in which the temperature and humidity environment was set to 23° C.-55% Rh, as a result of which it was found that the electrical resistance when negative voltage of 100 V was applied on the side of shaft 1*a* and positive voltage on the side of the developing roller surface 1*b* was $9.2\times10^6$ Ω·cm. Next, changing the voltage polarity, it was found that the electrical resistance was $9.2\times10^6$ Ω·cm when negative voltage of −100 V was applied on the side of developing roller surface 1*b* and positive voltage was applied on the side of shaft 1*a*. FIG. 5 is a graph showing the voltage dependence of the resistance under these conditions. This shows that there is no polarity dependence (current rectifying capability) of the resistance.

The surface 1*b* of developing roller 1 was then generated by dip coat processing. For example, pre-mixing was performed using a mixer to dilute thermosetting polyurethane produced by preparing polyurethane (trade name Neopac-R-9030) made by Zeneca Limited, using methanol. A viscosity of 5.5 (CP) was obtained by controlling the liquid temperature to 23±1° C. under ambient temperature of 23° C.-55% Rh. After this, this was immersed in the dissolved solution then pulled at a speed of 200 mm/min, and the surface film generated by heating and drying for one hour in an oven maintained at 120° C.

As a result of performing the dip coating treatment described above, a developing roll 1 was obtained formed with a coating film 1*b* of film thickness 7.0 μm yet whose surface had high hardness and excellent adhesion with the resilient body. Just as was done prior to this treatment, the electrical properties of the roller were investigated in a location where the temperature/humidity environment was set to 23° C.-55%Rh. As a result, a resistance of $2.7\times10^6$ Ω·cm was found on applying a negative voltage of 100V on the side of shaft 1*a* and a positive voltage on the side of surface 1*b* of developing roller 1. Next, changing the polarity of the voltage, resistance of 6.2×107 Ω·cm was found on applying a positive voltage on the side of shaft 1*a* and a negative voltage of −100V on the side of surface 1*b* of the developing roller. FIG. 4 is a graph showing the voltage dependence of the resistance. As shown in FIG. 4, polarity dependence of the electrical resistance (current rectifying capability) is displayed.

Consequently, by using a method of manufacture in which a film is formed by using such a dipping method, if the resistance of the developing roller 1 is taken as R1 when negative voltage is applied to the side of shaft 1*a* of the toner carrier and positive voltage is applied to the side of surface 1*b* and the resistance of the developing roller 1 is taken as R2 when positive voltage is applied to the side of shaft 1*a* and negative voltage is applied to the side of surface 1*b* of the toner carrier, a developing roller 1 can be obtained having a resistance characteristic satisfying the relationship 2<R1/R2<40.

Also, in an image forming apparatus according to the embodiment of the present invention, residual toner after transfer to the paper has been effected is recovered by cleaning blade 9 and is then returned into toner storage container 11 by rotation of a screw (not shown). Also, the image forming apparatus according to the embodiment of the present invention is formed such that residual toner is returned into toner storage container 11 by falling under its own weight from the upper central part of toner storage container 11. This is because the toner which has not been transferred is deteriorated, having a low level of charging, so if it were simply stirred by an agitator 6 on being returned at the end, there would be a limit to the extent to which uniform left/right mixing of toner 4 could be achieved and this would give rise to a difference in printing quality between left and right.

The position in which the residual toner is allowed to drop will now be described using Table 4. Toner that falls under its own weight from the left or right ends of the top of the toner storage container 11 gives rise to variation in the amount of charging up of the toner on the developing roller, resulting in a large value of ΔO.D. which indicates the variability of printing quality. In contrast, toner which falls under its own weight in the middle part gives rise to little variation in the amount of charging up of the toner on the developing roller, resulting in a small value of ΔO.D. which indicates the variability of printing quality. The problem of variability of printing quality can therefore be solved without increasing the stirring members by dropping the toner under its own weight from the top central portion of toner storage container 11.

TABLE 4

| Position of dropping the toner | Amount of charging up (−V) of the toner on the developing roller | Printing Quality (ΔO.D.) Density | Fog |
|---|---|---|---|
| Left end (L) | (L)38 (C)43 (L)50 | 0.05 | 0.00 |
| Center (C) | (L)46 (C)45 (L)47 | 0.02 | 0.00 |
| Right end (R) | (L)49 (C)43 (L)39 | 0.04 | 0.00 |

Note) Data on consumption of 70% of toner capacity

Thus, an image forming apparatus according to the present invention is an apparatus in which consideration is given to environmental protection measures and in which low toner running cost is achieved since residual toner recovered by the cleaner can be re-circulated to toner storage container 11 instead of being discarded, so enabling all the toner to be used up and constitutes an image forming apparatus that makes use of the fact that the developing roller of the present invention has a resistance characteristic which makes it resistant to fog.

It should be noted that although the present embodiment was described with reference to black toner of a non-magnetic single-component system for developing roller 1, the present invention is not restricted to the above embodiment and could be applied for example to full-color printing etc. whose future expansion is being considered. Furthermore, many modifications and alterations can of course be made within the scope of the present invention. Thus, the scope of protection of the present invention is not restricted to the embodiment described above but extends to the inventions set out in the claims and equivalents thereof.

Hereinabove, according to the present invention, there are provided a toner carrier having a resistance characteristic satisfying the relationship 2<R1/R2<40 where R1 is the resistance when a positive voltage is applied at the surface side and a negative voltage at the side of the shaft of the toner carrier and R2 is the resistance when a positive voltage is applied at the side of the shaft and a negative voltage at the side of the surface of the toner carrier and an image forming apparatus comprising this. High image quality is thereby obtained by an uncomplicated construction with no fog and stable image density.

Also, since the production of fog can be prevented, it becomes possible to use up residual toner recovered by the cleaner by re-circulating it, so enabling an image forming apparatus to be provided which is of high reliability and low running costs and wherein environmental problems regarding toner dust etc. are taken into consideration.

The present invention may be embodied in other specific forms without departing from the spirit or essential characteristics thereof. The present embodiment is therefore to be considered in all respects as illustrative and not restrictive, the scope of the invention being indicated by the appended claims rather than by foregoing description and all change which come within the meaning and range of equivalency of the claims are therefore intended to be embraced therein.

What is claimed is:

1. A toner carrier comprising:

a conductive shaft;

a conductive resilient layer provided at the circumference of said conductive shaft; and a surface film which covers said conductive resilient layer and on which toner is charged up and adheres, wherein the electrical resistance between said conductive shaft and said surface film is different depending on the polarity of a voltage applied between said conductive shaft and said surface film.

2. The toner carrier according to claim 1, wherein a ratio of a first electrical resistance at a first polarity and a second electrical resistance at a second polarity satisfies the relationship:

2<the ratio<40.

3. The toner carrier according to claim 1, having an electrical resistance characteristic satisfying the relationship 2<R1/R2<40 where R1 is the resistance in case that a positive voltage is applied at the side of said surface film and a negative voltage is applied at the side of said conductive shaft and R2 is the resistance in case that a positive voltage is applied at the side of said conductive shaft and a negative voltage is applied at the side of said surface film.

4. The toner carrier according to claim 1, wherein said resilient layer has a substrate skeleton comprising hydroxyl groups (OH) and isocyanate groups (NCO), their mol ratio satisfying NCO/OH<1 and the volume resistivity of said surface film is substantially $1\times10^{8}$ to $1\times10^{12}$ Ω·cm.

5. The toner carrier according to claim 1, wherein the thickness of said surface film is substantially 4 to 16 μm.

6. The toner carrier according to claim 1, wherein the surface roughness of said surface film is substantially 0.4 to 1.5 times the mean grain size of said toner.

7. An image forming apparatus comprising:

a toner carrier including a conductive shaft, a conductive resilient layer provided at the circumference of said conductive shaft and a surface film which covers said conductive resilient layer and on which toner is charged up and adheres; and an electrostatic latent image holder that holds an electrostatic latent image on its surface, the electrostatic latent image being rendered visible by transferring the toner to the electrostatic latent image by bringing said toner carrier into contact with said electrostatic latent image holder with voltage applied between said conductive shaft and said surface film, wherein the electrical resistance between said conductive shaft and said surface film is different depending on the polarity of the applied voltage.

8. The image forming apparatus according to claim 7, wherein a ratio of a first electrical resistance at a first polarity and a second electrical resistance at a second polarity satisfies the relationship:

$$2<\text{the ratio}<40.$$

9. The image forming apparatus according to claim 7, having an electrical resistance characteristic satisfying the relationship 2<R1/R2<40 where R1 is the resistance in case that a positive voltage is applied at the side of said surface film and a negative voltage is applied at the side of said conductive shaft and R2 is the resistance in case that a positive voltage is applied at the side of said conductive shaft and a negative voltage is applied at the side of said surface film.

10. The image forming apparatus according to claim 7, wherein said resilient layer has a substrate skeleton comprising hydroxyl groups (OH) and isocyanate groups (NCO), their mol ratio satisfying NCO/OH<1 and the volume resistivity of said surface film is substantially $1\times10^{8}$ to $1\times10^{12}$ Ω·cm.

11. The image forming apparatus according to claim 7, wherein the thickness of said surface film is substantially 4 to 16 μm.

12. The image forming apparatus according to claim 7, wherein the surface roughness of said surface film is substantially 0.4 to 1.5 times the mean grain size of said toner.

13. An image forming apparatus, comprising:

a toner storage unit that stores toner;

a toner carrier including a conductive shaft, a conductive resilient layer provided at the circumference of said conductive shaft and a surface film which covers said conductive resilient layer and on which toner is charged up and adheres; and an electrostatic latent image holder that holds an electrostatic latent image on its surface, the electrostatic latent image being rendered visible by transferring the toner to the electrostatic latent image by bringing said toner carrier into contact with said electrostatic latent image holder with voltage applied between conductive shaft and said surface film, wherein, in case that residual toner on said electrostatic latent image holder is returned into said toner storage unit after the toner has been transferred to recording paper, the residual toner is allowed to fall under its own weight within said toner storage unit from the top central part of said toner storage unit.

* * * * *